US012698631B1

(12) United States Patent
Patton

(10) Patent No.: US 12,698,631 B1
(45) Date of Patent: Aug. 4, 2026

(54) PREFABRICATED DECK, WALL, AND ROOF SYSTEMS

(71) Applicant: MFI Real Estate, LLC, Austin, TX (US)

(72) Inventor: Thomas A. Patton, Austin, TX (US)

(73) Assignee: MFI Real Estate, LLC, Austin, TX (US)

( * ) Notice: Subject to any disclaimer, the term of this patent is extended or adjusted under 35 U.S.C. 154(b) by 0 days.

(21) Appl. No.: 19/378,003

(22) Filed: Nov. 3, 2025

(51) Int. Cl.
*E04C 2/04* (2006.01)
*E04C 2/52* (2006.01)

(52) U.S. Cl.
CPC ..... *E04C 2/044* (2013.01); *E04C 2/521* (2013.01)

(58) Field of Classification Search
CPC ..... E04C 2/044; E04C 2/521; E04C 2/526; E04B 5/02
See application file for complete search history.

(56) References Cited

U.S. PATENT DOCUMENTS 3,811,722 A * 5/1974 Jones ..... E04B 1/34352 296/900
3,834,111 A * 9/1974 Acker ..... B60P 3/40 52/143
3,944,242 A * 3/1976 Eubank ..... B28B 1/14 280/495
4,059,939 A * 11/1977 Elliott ..... E04C 2/284 52/745.11
4,096,675 A * 6/1978 Howard ..... E04B 1/35 52/143
4,200,305 A * 4/1980 Eubank ..... B60P 3/40 280/405.1
4,320,607 A * 3/1982 Eubank ..... B66F 3/46 52/223.6
5,113,625 A * 5/1992 Davis ..... E04B 1/34336 52/143
5,201,546 A * 4/1993 Lindsay ..... E04B 5/14 280/789
6,101,779 A * 8/2000 Davenport ..... E04B 1/04 52/223.6
6,254,132 B1 * 7/2001 Lindsay ..... B62D 21/02 280/789
6,467,223 B1 * 10/2002 Christley ..... E04B 5/04 52/143
6,622,442 B2 * 9/2003 Kwon ..... E01D 19/125 403/348
6,681,535 B1 * 1/2004 Batchelor ..... B62D 33/08 52/143
6,821,066 B2 * 11/2004 Wehrli ..... B60P 3/40 410/32

(Continued)

*Primary Examiner* — Rodney Mintz
(74) *Attorney, Agent, or Firm* — Foley & Lardner LLP

(57) ABSTRACT

A prefabricated modular building system includes any of a deck, wall panel, and roof panel, each of which can, but need not always, include an ultra-high-performance concrete portion bonded to a foam portion to form a composite. The deck includes connection points for attachment of a stabilization structure and for releasable attachment of transport components such as a hitch and axle assemblies. The deck is fabricated off-site, and transportable to a delivery site where the transport components can be detached and the deck is placed on a foundation or piers. The stabilization structure can, in some implementations, form a complete building.

17 Claims, 14 Drawing Sheets

(56) References Cited

U.S. PATENT DOCUMENTS 7,021,014 B1 * 4/2006 Wolfe ..... E04B 1/14 52/270
7,065,926 B2 * 6/2006 Brandt ..... B62D 21/20 280/789
7,112,029 B1 * 9/2006 Neatherlin ..... B62D 53/065 280/43.23
7,165,370 B1 * 1/2007 Wolfe ..... E04B 1/14 52/143
7,877,954 B1 * 2/2011 Saebi ..... E04B 1/14 52/309.3
8,919,057 B1 * 12/2014 Dupray ..... E04B 5/36 52/223.6
9,611,645 B1 * 4/2017 Dupray ..... E04C 5/08
10,011,980 B1 * 7/2018 Shipps ..... E04B 1/34352
10,094,112 B1 * 10/2018 Dupray ..... E04B 5/36
10,155,467 B2 * 12/2018 Neatherlin ..... B60P 3/40
10,815,663 B1 * 10/2020 Dupray ..... E04B 5/36
11,313,125 B2 * 4/2022 Neatherlin ..... E04B 5/04
11,858,407 B2 * 1/2024 Point ..... E04B 1/34336
11,891,807 B2 * 2/2024 Neatherlin ..... G01D 5/24
2004/0128941 A1 * 7/2004 Brandt ..... B62D 21/20 52/690
2004/0213643 A1 * 10/2004 Wehrli ..... B60P 3/40 410/32
2015/0203020 A1 * 7/2015 Neatherlin ..... B60P 3/40 414/800
2020/0217073 A1 * 7/2020 Neatherlin ..... G07C 9/00944
2021/0388603 A1 * 12/2021 Schultz ..... E04B 7/024
2022/0090380 A1 * 3/2022 Dombowsky ..... B32B 3/06
2022/0251837 A1 * 8/2022 Neatherlin ..... E04C 5/08
2022/0297588 A1 * 9/2022 Point ..... B60P 3/32
2024/0175301 A1 * 5/2024 Neatherlin ..... E05B 81/77

* cited by examiner

PREFABRICATED DECK, WALL, AND ROOF SYSTEMS

I. BACKGROUND

Description of the Related Art

U.S. Pat. No. 3,834,111 entitled "Method For Transporting Building Modules" discloses "A building module transporter for connection to a towing vehicle comprising a building module and module carriers attached to end walls of the module and resting on carrier supports. The carriers are firmly secured to the module at vertically spaced points to suspend the module between them and to permit the raising and lowering of the suspended module by pivoting the carriers about horizontal axes with respect to the supports. Means is provided for moving the module with respect to the carriers in a lateral direction to facilitate the precision alignment of the module with a foundation at the building site. The spaced connection points between the module and the carriers tension a lower portion of the suspended building and place an upper portion thereof in compression."

U.S. Pat. No. 4,200,305 entitled "Trailer assembly for carrying overwidth loads" discloses "A trailer assembly for carrying overwidth loads such as large rectangular concrete slabs. The trailer includes two separate units, a front unit and a rear unit. Each unit includes a frame mounted on a set of tandem wheels. The front unit has upper and lower frames rotatably connected together, allowing the wheels to turn with respect to the upper frame. A tongue is hingedly connected to the front unit. It has a hitch for connection to the towing vehicle and a compression device to apply weight to the hitch for compressive connection with the towing vehicle. Longitudinal cross members are mounted across the front and rear units to support the load. The cross members can be removed and stored parallel to the length of the units for legal width return trip towing. On return trip, the rear unit is towed reverse to the direction towed while loaded. Also disclosed is an embodiment employing two units the same or similar to the front unit to enable being moved laterally to facilitate parking in close space."

U.S. Pat. No. 7,112,029 entitled "Carrier Apparatus and Method" discloses "A carrier apparatus and method includes a pair of oppositely positioned carriers. At least one pair of steerable wheels is connected to at least one of the oppositely positioned carriers. A movable neck is connected to each of the oppositely positioned carriers and by compressive engagement to an object to be carried such that neither the movable neck, nor the pairs of steerable wheels, nor the pair of oppositely positioned carriers are underneath the object."

U.S. Pat. No. 10,155,467 entitled "Systems And Methods For Transporting A Structure" discloses "A system and method for lifting and moving a structure comprises at least two bolster assemblies configured to engage substantially opposing ends of the structure, a plurality of tensioned components extending between the bolster assemblies, applying a compressive force to clamp the bolster assemblies to the structure, and applying a lifting force to the bolster assemblies to lift the structure."

U.S. Pat. No. 11,891,807 B2 entitled "Mobile modular foundation systems and methods for transporting same" discloses "A modular foundation system comprises a concrete reinforced matrix having embedded pre-tensioned components and a recessed tension bolster region adjacent the lower surface of the foundation at each end, and a pair of lifting safety bars partially embedded in the foundation within the recess and terminating at the end of the foundation."

U.S. Pat No. 7,877,954B1 titled "Composite buildings and methods of constructing composite buildings" discloses "The invention contemplates constructing a building by making composite walls in a factory using continuous or batch processing equipment. To make the walls, a Fiber Reinforced Coating (FRC) is prepared and then applied to foam core panels on their faces. Preferably, the panels are precut to the required dimensions before coating with openings for doors and windows. The coated panels are then transported to the site and bonded together to form the building." There is a need for improved prefabricated deck, wall, and roof systems and means for transporting and installing them.

II. SUMMARY

The disclosure below uses different embodiments to teach the broader principles with respect to articles of manufacture, apparatuses, processes for using the articles and apparatuses, processes for making the articles and apparatuses, and products produced by the process of making, along with necessary intermediates.

This Summary is provided to introduce the idea herein that a selection of concepts is presented in a simplified form as further described below. This Summary is not intended to identify key features or essential features of subject matter, nor is this Summary intended to be used to limit the scope of claimed subject matter. Additional aspects, features, and/or advantages of examples will be indicated in part in the description which follows and, in part, will be apparent from the description, or may be learned by practice of the disclosure.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using bolding, italics, and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, processes and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

With the foregoing in mind, consider articles, apparatuses, processes of using and making the foregoing, products, and necessary intermediates with respect to the manufacture, transport, installation, and use of prefabricated structures, such as homes or buildings, or parts thereof.

III. BRIEF DESCRIPTION OF THE FIGURES

IV. MODES

Figure 1:
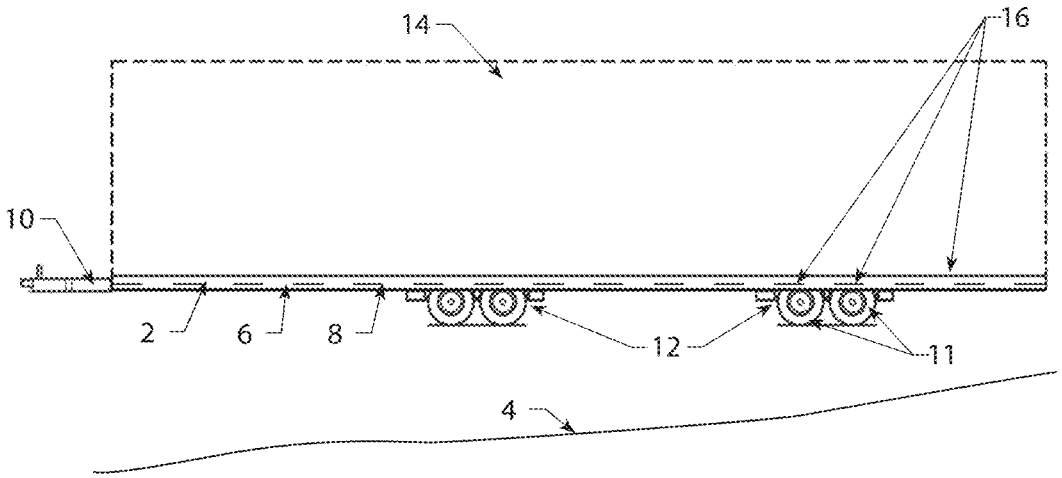
FIG. 1 is a view illustrating a prefabricated deck located off-site, showing the concrete portion, foam portion, hitch, axle assemblies, wheels, and stabilization structure attached to connection points.

The embodiments discussed herein can, but need not necessarily, involve or relate to fabrication or prefabrication such as for at least some of a prefabricated building, e.g., a house.

In some embodiments, the disclosure provides systems and processes for fabricating, transporting, and installing prefabricated structural components suitable for use in modular or mobile buildings. The disclosed fabrication processes can be conducted off-site and yield prefabricated structures such as decks, wall panels, and roof panels (and portions thereof). Each structure can, but need not always, be formed to include ultra-high-performance concrete (UHPC). Illustratively, Duralite™ is a commercially available UHPC, though embodiments herein are not limited to this product. The UHPC commonly is composed of ordinarily Type I grey or white Portland cement, high-range water-reducing admixture, slag, and water. To make the UHPC lightweight, it can be composed of lightweight aggregate such as commercially available Poraver or any expanded or hollow glass aggregate made of soda-lime-borosilicate glass to reduce the self-weight of the structure. The composition of the UHPC may contain polyethylene fiber or glass fiber for ductile strength. Varying amounts of slag and quartz sand can be included in the mixture to increase strength.

Each structure can, but need not always, be formed to include reinforcement, and foam, e.g., EPS or XPS foam, a polymeric foam which may be cut, routed, or otherwise shaped for weight reduction and conduit passages, and which may serve an insulation material. And if so desired, each structure can be configured for releasable connection to transport component, i.e., any releasable road-transport hardware, including such as hitch tongues and axle assemblies with wheels.

In some embodiments, a prefabricated deck is fabricated off-site by positioning a foam portion on a casting bed and casting a UHPC (i.e., concrete portion) portion against the foam to bond the portions together. As may be desired, the deck can be fabricated by placing at least one utility conduit, embedding reinforcement within the UHPC, and embedding connection points for attachment of a stabilization structure. The stabilization structure can also be fabricated off-site and joined to the prefabricated deck using at least some of the connection points prior to transport. One or more axle assemblies and/or a hitch can be releasably attached to the prefabricated deck for roadway transport. At a delivery site, the transport components can be detached, and the prefabricated deck can be placed on a foundation, if so desired, joined to a second deck that may, but need not always, be fabricated as above.

The prefabricated deck can include integrated utility conduits configured for connection to site utilities. In some embodiments, the deck can include a concrete inflow pattern—e.g., an integrated deflection-reducing shape—to enhance strength and load capacity, e.g., without adding significant weight. The deck may serve as a chassis for a trailer or mobile home. In some cases, after removal of transport components, the deck can become a permanent part of a building, such as a home.

In some embodiments, the stabilization structure is configured to be attachable to the prefabricated deck off-site and detachable at the delivery site, to provide support for the deck during transport. In other embodiments, the stabilization structure comprises one or more wall panels, one or more roof panels, or both. The wall panel and roof panel can include UHPC, foam, or combinations thereof. Each panel, like the deck, can include a concrete (e.g., UHPC) inflow pattern and may incorporate one or more utility conduits or mechanical lines. The wall panel (which may constitute an entire wall) can include connection points configured to couple with the prefabricated deck, and the roof panel (which may constitute an entire roof) can include connection elements configured to couple with the wall panel(s).

In some embodiments, a roof panel is lifted onto a wall panel installed on the prefabricated deck, and if so desired, after which utility conduits in the wall panel can be connected to corresponding conduits in the deck. The roof and wall panels can thereby complete an enclosed structure, such as a building or a house, and the foam portions can provide thermal insulation.

In some embodiments, the prefabricated deck, wall panel(s), and roof panel are joined off-site to form at least part of a building or house that can be transported to the delivery site as an assembled module. Transporting can include towing the deck by the attached axle assemblies and/or hitch. Upon arrival, the axle assemblies and hitch can be detached, and the prefabricated structure placed on a foundation, e.g., foundation points. The deck can remain in whole or as part of the building after removal of the transport components.

In other embodiments, the prefabricated structures can be transported individually and joined on-site to form a building enclosure. Utility conduits integrated within the prefabricated structures can be coupled to site utilities to complete installation.

Some embodiments include a prefabricated deck and one or more transport components releasably attachable thereto, e.g., including first and second axle assemblies, a hitch, or both. The prefabricated deck can include a foam portion 8 bonded to a UHPC portion and may incorporate connection points for attachment of a stabilization structure 14. The stabilization structure 14 can comprise one or more wall and roof panels, and in some cases, at least one of which comprises UHPC; the same applies to internal walls that can likewise be joined to the deck structure 2, wall panel(s) 66, and roof panel(s) 90. The stabilization structure 14 can be a building or house. The foam portion 8 can provide thermal insulation, and the building or house can include a joint system joining a wall panel(s) to the deck.

The prefabricated deck can include a concrete inflow pattern, e.g., formed adjacent the foam portion and can include integrated utility conduits for connection to site utilities. Each transport component can be configured to be attached to the prefabricated deck 2 off-site and detached at delivery site 88.

Overview of Prefabricated Deck (FIG. 1)

FIG. 1 illustrates a prefabricated deck 2 located at an off-site 4 facility 4 (e.g., a factory or yard). The deck 2 includes a concrete portion 6 (which in many embodiments is made of ultra-high-performance concrete, UHPC) and a polymeric foam portion 8 adjacent to or encapsulated by the concrete portion 6. Deck 2 is configured with connection points 16 for releasable attachment to transport components such as a hitch 10 and at least one axle assembly 12 (each axle assembly 12 having at least one an axle 13 with wheels 11 at its ends). FIG. 1 further shows a stabilization structure 14 (for example, a building or house, or portion thereof) attached to deck 2's connection points 16. In the illustrated embodiment, the concrete portion 6 provides the principal load-bearing function, while the foam portion 8 adds dimensional volume, thermal insulation, and serves as a lightweight substrate for embedded conduits 48 (discussed below). Together, these materials form a composite sandwich panel that is capable of resisting bending and torsion generally without auxiliary framing, functioning as a chassis during transportation on wheels 11.

Material Properties and Composite Structures

Ultra-high-performance concrete is a class of advanced concrete generally characterized by compressive strength significantly higher than conventional concrete (often >150 MPa, or about 21.7 ksi) and the capacity to sustain tensile stresses above 5 MPa when fiber-reinforced. This gives the concrete portion 6 load-bearing capacity and ductility, as well as extreme durability (UHPC is highly impermeable and can endure aggressive environmental conditions—for instance, it retained essentially all its material properties after 600 freeze-thaw cycles). UHPC structures are thus expected to have very long service lives (a projected 100-year lifespan is often cited under normal use conditions). The foam portion 8 is a rigid closed-cell polymeric insulation (for example, expanded or extruded polystyrene). This foam core can, but need not always, have a density on the order of 25-45 kg/m$^3$ (much lower than concrete's ~2400 kg/m$^3$) and a minimum compressive strength typically around 0.17 MPa (~25 psi), yet it provides substantial thermal insulation (approximately R-4 to R-5 per inch of thickness). Because the foam is extremely lightweight—often about 1-2% of the concrete's density—it dramatically reduces the overall weight of the deck 2 while adding insulation. The concrete portion 6 and foam portion 8 are bonded (both chemically and mechanically) so that they act compositely: the high-stiffness UHPC outer shell carries structural loads, and the low-density foam core increases the panel's thickness without adding much weight, thereby boosting the stiffness-to-weight ratio. This design yields a robust yet lightweight deck module; it behaves similar to a structural insulated panel, where the UHPC acts as strong faces and the foam as a shear-supporting core. As a result, the deck 2 can support heavy loads with minimal deflection, achieving a high load-bearing capacity relative to its mass. Additionally, the foam core contributes to thermal performance—the deck 2 itself provides insulation for any structure built on it, enhancing energy efficiency and occupant comfort.

Alternatively, stabilization structure 14 can be configured to be attachable to the prefabricated deck 2 at the off-site 4 location and detachable at the delivery site (as discussed below). For example, in some embodiments the stabilization structure 14 comprises a removable bracing assembly attached to cast-in connection points 16 of the deck 2 via removable fasteners 62. Such a bracing or stabilization assembly can take various forms, including: a prefabricated wall-and-roof box frame; a cross-braced steel truss rack; a column-and-cable stabilization frame; a central spine or cage structure; a removable shear-diaphragm platform or lattice; or a hybrid UHPC-and-steel skeletal structure.

Each of the above can be configured to couple to the deck 2's connection points 16 (for instance, via bolts or clamps) while the module is off-site 4, and to be detached at the delivery site after the deck 2 is placed on a foundation (piers, footings, etc.), as discussed below. These temporary stabilization structures 14 can provide rigidity (e.g., acting as bracing) to the module during transport and are removed upon installation, especially if the deck 2 will be joined with a permanent building structure at the delivery site 88.

Off-Site Fabrication of Composite Deck (FIGS. 2-16)

Figure 2:
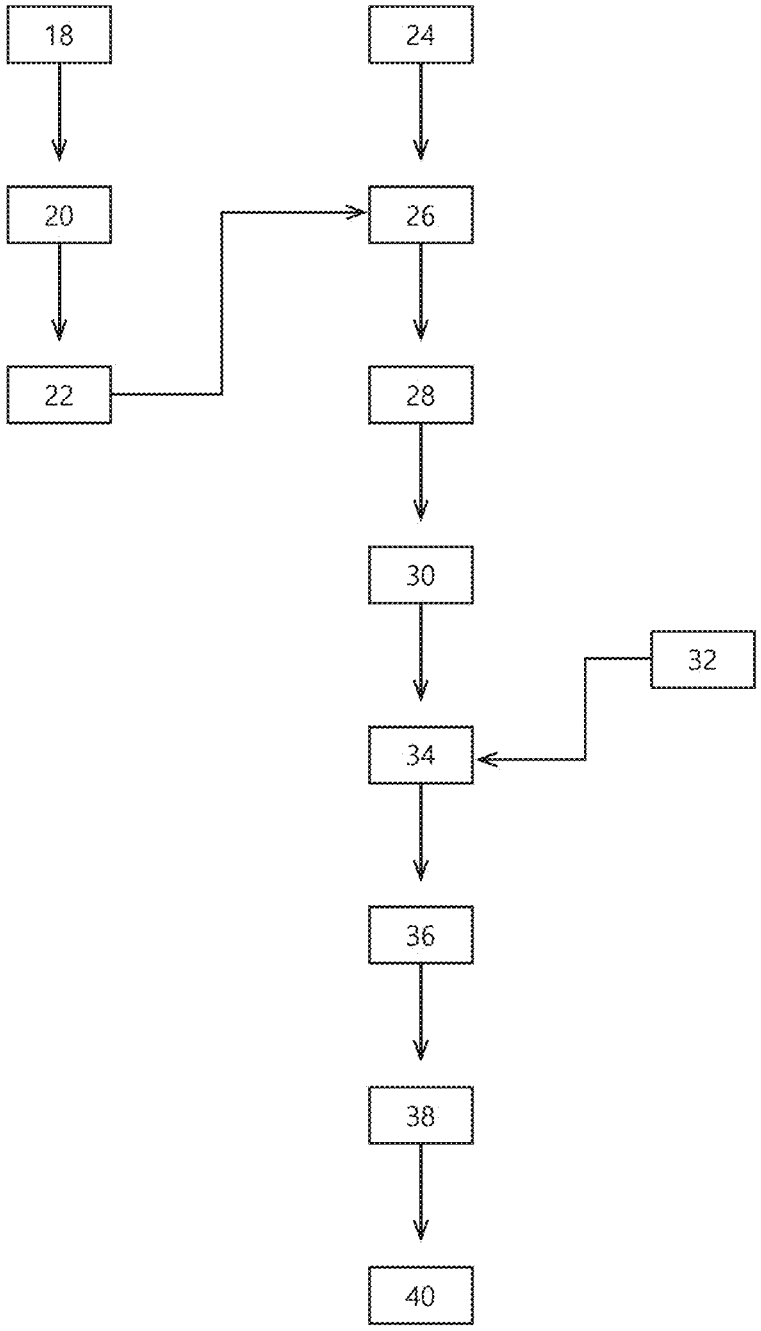
FIG. 2 is a process flow diagram showing the fabrication sequence of the prefabricated deck, including cutting the foam, routing utilities, forming, and sealing the formwork, placing reinforcement, and casting the concrete portion.
Figure 3:
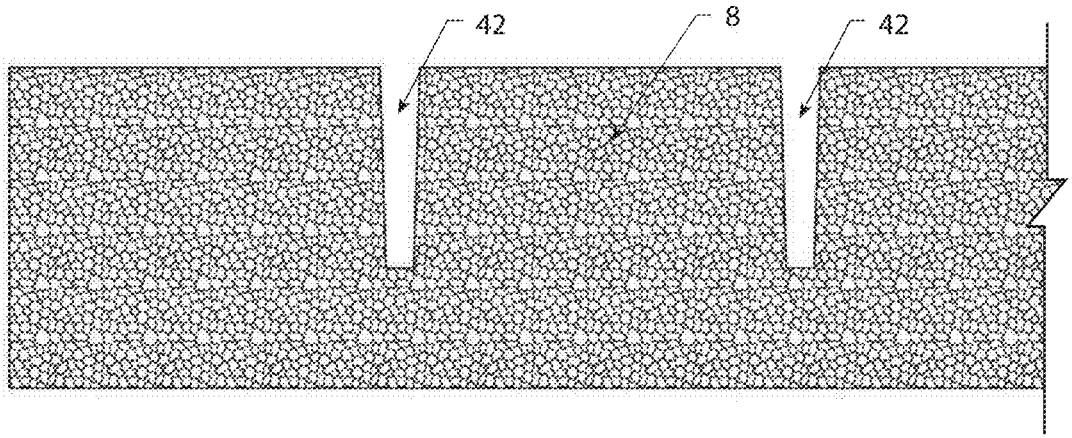
FIG. 3 is a schematic view showing the cutting of voids into the foam portion to form intersecting channels, allowing concrete to flow therein to enhance rigidity and bonding.
Figure 4:
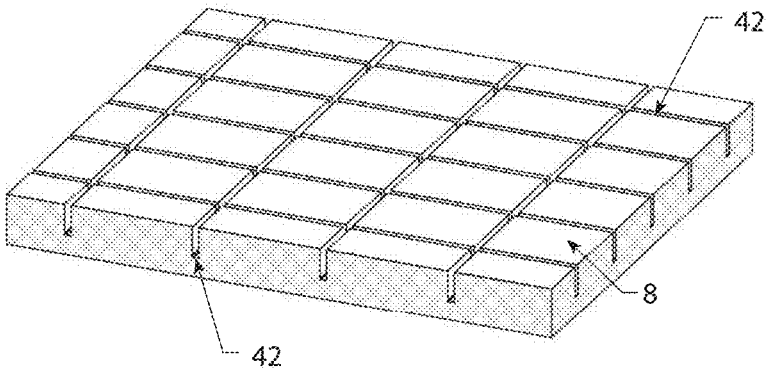
FIG. 4 is a schematic view showing the cutting of voids into the foam portion to form intersecting channels, allowing concrete to flow therein to enhance rigidity and bonding.
Figure 5:
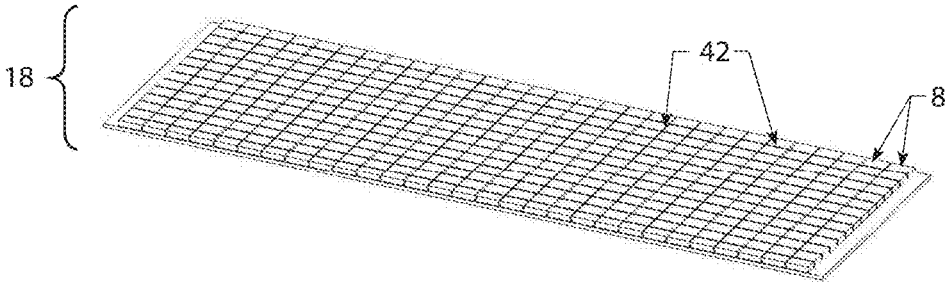
FIG. 5 is a schematic view showing the cutting of voids into the foam portion to form intersecting channels, allowing concrete to flow therein to enhance rigidity and bonding.
Figure 6:
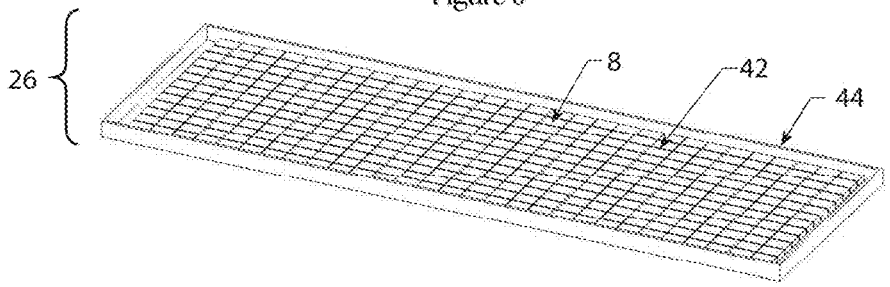
FIG. 6 is a partial view showing placement of the foam portion into a steel formwork frame.

FIG. 2 depicts a fabrication sequence that can, and typically is, performed entirely off-site 4 under controlled factory conditions. This process can be summarized in the following stages (corresponding to the flowchart blocks in FIG. 2)

Preparing Foam Core (Block 18)

The foam portion 8 is cut to shape 18 to the footprint and profile, including any recesses or contours needed, to mate with the concrete portion 6. In some designs, the foam may occupy most of the deck 2's volume, while in others it may be shaped to leave certain voids or cavities (discussed further below). Cutting is done to achieve the desired dimensions and to form features that will later interface with concrete (see FIGS. 3-5 for examples). Accommodation for windows and doors can be made with leave outs. Leave outs can be made with a steel box with the same or similar properties of the formwork or tub, discussed below., and coated with a release agent to allow for removal after curing. Depending on the formwork type, the "walls" of the box can be clamped, screwed or magnetized in place to shutter off the areas that don't require concrete.

Embedding Utilities (Blocks 20 & 22)

Figure 7:
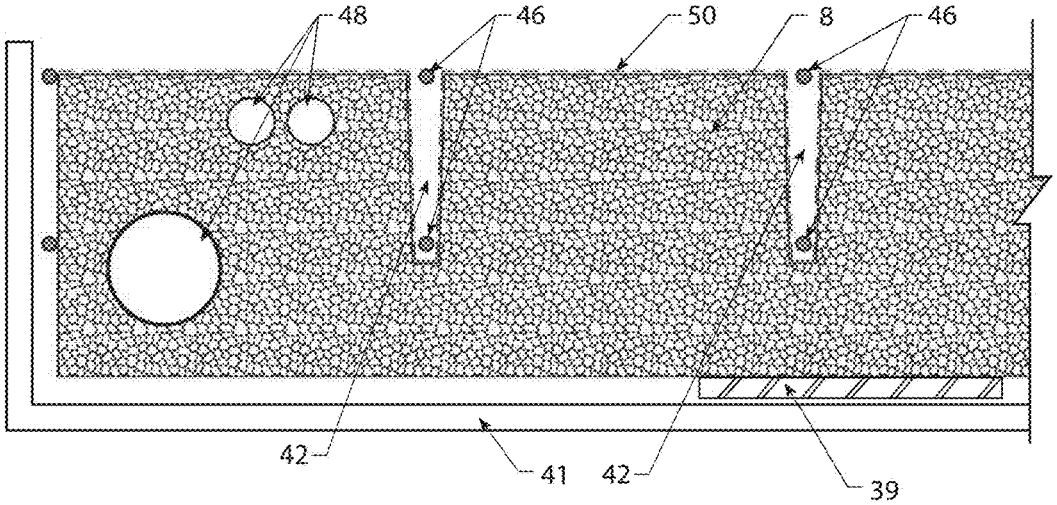
FIG. 7 is a sectioned partial view illustrating the foam portion within a formwork tub, including conduits, reinforcement, embeds, and an air barrier adjacent the foam portion.

Channels or routes are formed into the foam portion 8 for utilities such as electrical conduits, plumbing pipes, and HVAC ducts. This routing for utilities, in block 20, can be done by cutting grooves or openings in the foam wherever wiring or piping is needed. After routing, the actual conduits and pipes 48 for these utilities are laid into the foam (as per block 22, FIG. 7 illustrates conduits 48 installed in pre-cut foam channels). By integrating utility lines within the foam core at the factory, on-site work is minimized. The foam can serve as pre-packaged "services space" for the module's electrical and plumbing systems.

Plumbing lines are usually connected above or below deck 2, so the route for the pipes can be predetermined. Connections can be done above the deck 2, and/or outside via utility holes to connect to the street; embodiments that have a crawl space 94 allow connections below deck 2. Inside walls, above deck 2, there can be access panels if desired. Through-roof panel penetrations of pipes can be accomplished by running the wall pipes long and connecting to an opening in the roof panel 90 to accommodate the pipe, then wall and roof panels 90 and the pipes can be sealed.

Electrical wires, such as Romex can run through the conduits provided, and would exit floor, wall, or roof/ceiling where fixtures are located, e.g., for lights, fans, outlets, with a main electrical panel, subpanels, etc. at each location specified by code at the delivery site; there can be a junction box where an access panel is located. For panel-to-panel jumps, the wires can be run long, leaving a "whip" to fish through the adjacent panel's conduits to get to the terminal point.

Access panel locations can be placed as leave-outs during the concrete pour, so that no concrete will lay on those locations, and the foam can be cut as voids either before or after the concrete pours.

Formwork Setup (Blocks 24 & 26)

A rigid formwork frame 44 is fabricated to define the shape of the concrete portion 6 during casting. This formwork can be made of steel or another stiff material, and it establishes the deck 2's dimensions and the texture/finish of its underside. The prepared foam portion 8 is placed into the formwork (e.g., laid on a level casting bed within the frame) in the proper position. At this stage, the formwork 44 acts as a mold, holding the foam and later the concrete mix in the configuration for the desired application.

Sealing and Release (Block 28)

Before pouring concrete, the formwork is sealed—for example, a thin polymer film or liner can be applied to any gaps to prevent leakage of cement paste. Additionally, a release agent (such as wax or oil) may be coated on the formwork surfaces to ensure that the hardened concrete will not stick to the formwork, allowing easy demolding after curing. This preparation effectively turns the formwork into a non-stick mold for the UHPC shell.

Placement of Reinforcement (Block 30)

Steel reinforcements and embeds are positioned in the formwork in anticipation of the concrete pour. For instance, rebar or mesh may be laid to reinforce the concrete portion 6, and any mechanical connection points 16 (embedded plates, threaded inserts, lifting hooks, etc.) are secured in place. Post-tensioning ducts or tendon sleeves can also be arranged at this stage if the design calls for tensioning the deck 2 later. The anchor points of these reinforcements are aligned with the intended connection regions (for example, where bolts 72 for attaching wall panels 66 or the hitch 10 will go). FIG. 7 provides an illustration of this stage, showing how reinforcement 46 (including steel embeds 39 and tendons) can be placed extending into voids 42 in the foam, ready to be encapsulated by concrete. Ensuring proper reinforcement placement is useful, since the UHPC will carry most structural loads; thus anchors 39 for the axle assemblies 12 or building connections are set such that they will be fully anchored in the concrete portion 6 once it cures.

Mixing UHPC Concrete (Block 32)

A batch of concrete, e.g., ultra-high-performance concrete, is mixed to a flowable, self-compacting consistency. The composition of the UHPC mix can include Portland cement, fine silica sand (or alternatively a lightweight fine aggregate such as expanded glass beads to reduce weight), supplementary cementitious materials like silica fume or slag, and a high-range water-reducing admixture. Typically, fibers (e.g., steel, polyolefin, or glass fibers) are added to the mix to enhance its post-crack toughness and ductility. The water-to-binder ratio is kept low (often <0.25) to achieve the high strength and low porosity characteristic of UHPC. This mixture, once prepared, behaves like a thick fluid (self-leveling concrete), which is ideal for casting around complex reinforcement and foam shapes.

Casting Concrete Shell (Block 34)

Figure 8:
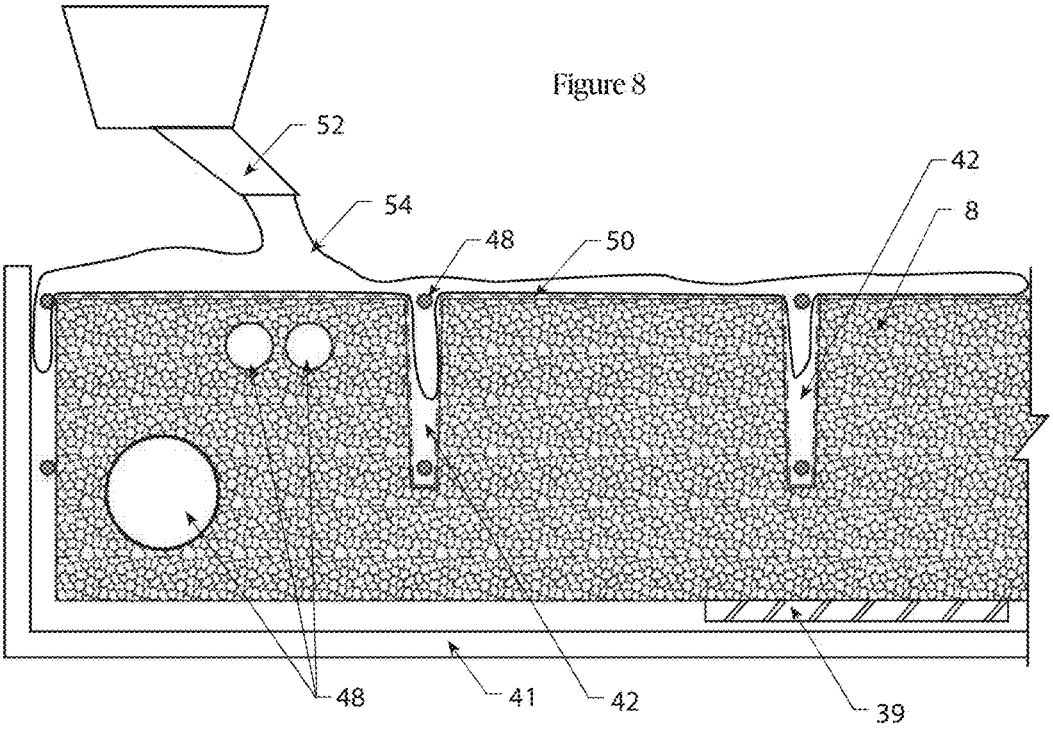
FIG. 8 is a view showing a hopper pouring ultra-high-performance concrete mix into the formwork to encapsulate reinforcement, conduits, and the foam portion.
Figure 9:
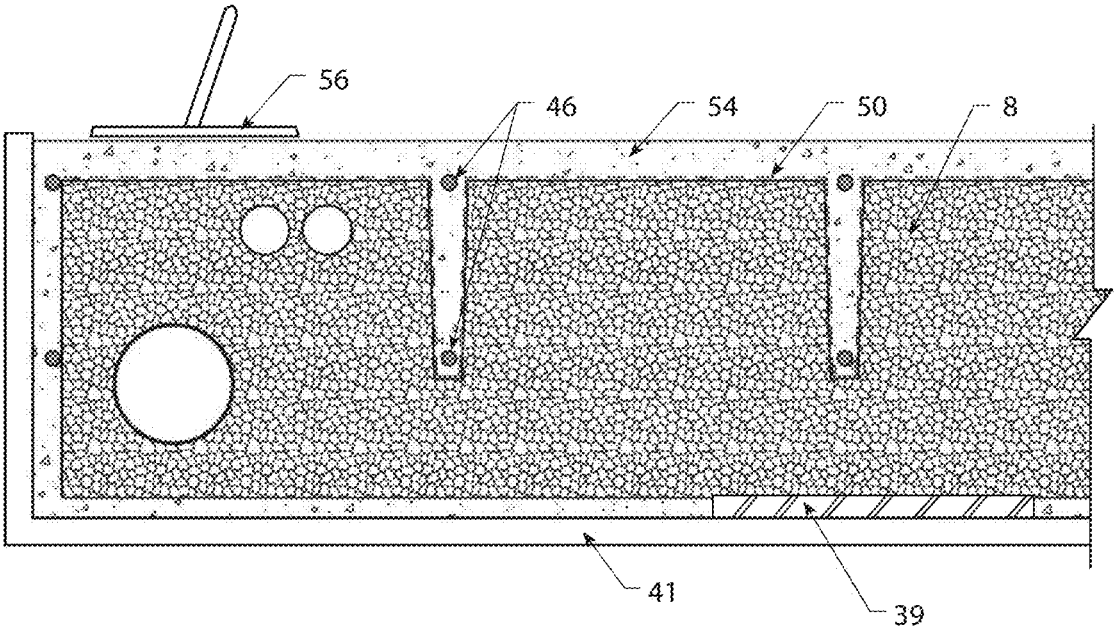
FIG. 9 is a view illustrating smoothing of the concrete surface with a trowel prior to curing.
Figure 10:
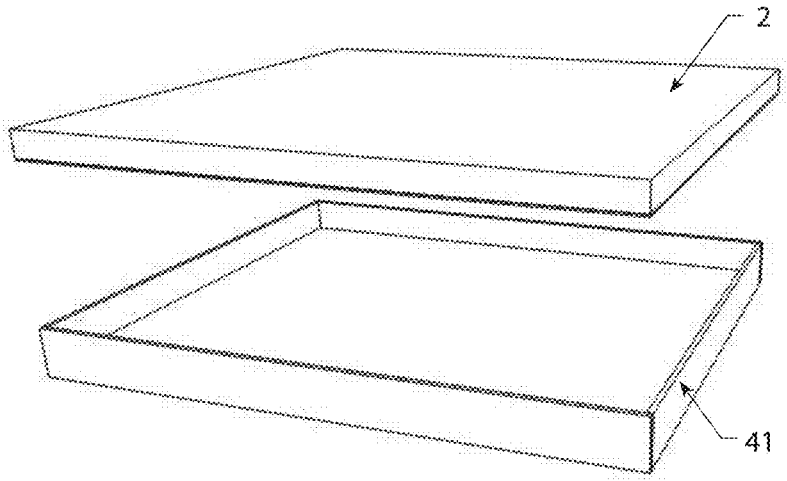
FIG. 10 is a sectional and perspective view illustrating removal of the cured deck from the formwork tub, showing embodiments with and without the frame formwork remaining in the finished structure.
Figure 11:
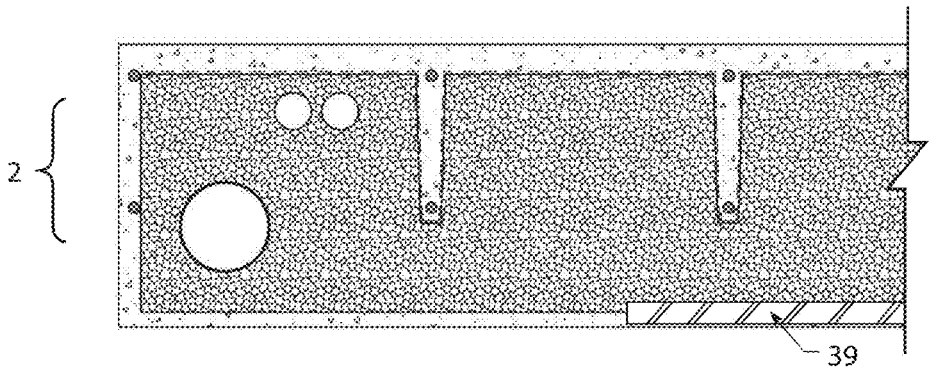
FIG. 11 is a sectional view illustrating removal of the cured deck from the formwork tub, showing embodiments with and without the frame formwork remaining in the finished structure.
Figure 12:
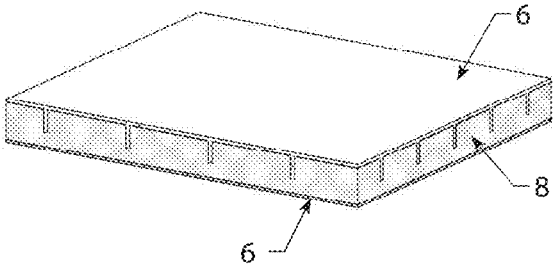
FIG. 12 is a sectional and perspective view illustrating removal of the cured deck from the formwork tub, showing embodiments with and without the frame formwork remaining in the finished structure.
Figure 13:
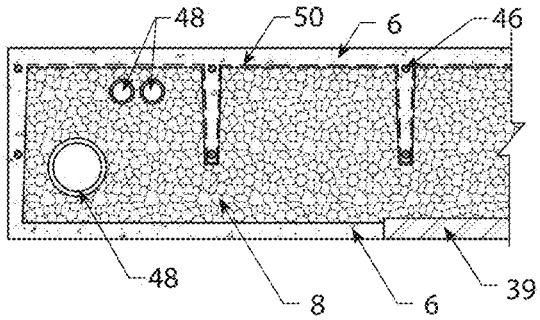
FIG. 13 is a sectional view illustrating removal of the cured deck from the formwork tub, showing embodiments with and without the frame formwork remaining in the finished structure.

The concrete, e.g., UHPC, mix is then placed into the formwork, coating and covering the exposed surfaces of the foam portion 8. This may be accomplished by pouring from a hopper and using vibratory screeds or distribution heads to ensure the mix flows into cavities and around inserts. FIG. 8 illustrates a hopper 52 pouring the concrete mix 54, which flows into the foam's voids 42 and envelops the rebar, embeds, and any installed conduits and pipes 22, thereby bonding intimately with the foam portion 8. In some embodiments, the casting is done in multiple stages (pours). For example, a first pour can be made to create a thin layer of concrete at the bottom of the form (forming the underside of deck 2). The foam portion 8 is then placed on this initial layer. Subsequently, a second pour is made to fill the space between the foam and the formwork walls and to cover the top of the foam. This two-stage approach ensures that the foam is fully encased by concrete on intended sides. The result after Block 34 is a "sandwich" wherein the foam core 8 is enveloped (on bottom, sides, and top surface) by the UHPC concrete portion 6. Notably, if a steel frame formwork 44 is used, the concrete may also encapsulate it (if the frame is not removed)—effectively casting the frame into the structure for additional reinforcement, as discussed below. In some embodiments, frame 44 can include embeds to grip the concrete after it sets. Before the concrete sets, the upper surface can be leveled and finished. FIG. 9, for instance, shows a trowel 56 being used to smooth the fresh concrete mix 54 on top of the foam prior to curing, ensuring a flat, even deck 2 surface.

Initial Setting and Curing (Blocks 36 & 38)

After placing the concrete, any additional small inserts or components (such as attachment plates or bolts that must be positioned) can be quickly adjusted or embedded while the mix 54 remains fluid (as indicated by Block 36 for placing embeds 39). Then the concrete is allowed to undergo initial set and curing. Curing is preferably done under controlled conditions; for UHPC, this often means maintaining elevated temperature and humidity (e.g., steam-curing or heat-curing in a chamber) to accelerate strength gain and achieve material properties for the desired application. Accelerated curing helps the concrete portion 6 reach the high compressive strengths for structural use more quickly. By the end of this stage, the UHPC has hardened into a shell (or thick skin) around the foam, forming a composite deck 2 with strength to for removal from the mold and subsequent handling. Because UHPC exhibits low shrinkage and creep, the shape of the deck 2 remains true to the formwork and the structure is dimensionally stable. The resulting deck 2 has a high stiffness-to-weight ratio and minimal long-term deformation, useful attributes for a module that will be transported and then used as a floor system.

Formwork Removal (Block 40)

Figure 14:
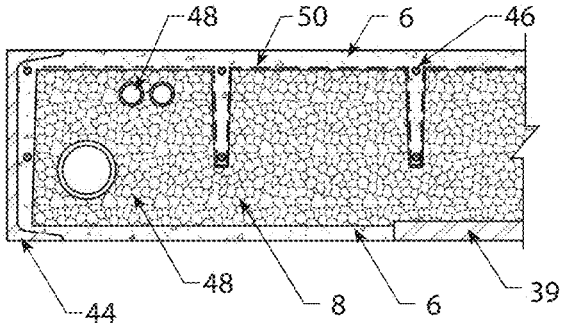
FIG. 14 is a sectional view illustrating removal of the cured deck from the formwork tub, showing embodiments with and without the frame formwork remaining in the finished structure.

Once the concrete has reached the target strength, the formwork is removed. This may involve detaching side frames and lifting the prefabricated deck 2 out of a formwork tub 41 (as illustrated in FIGS. 10-13). At this point, the deck 2 is a single monolithic piece—a fusion of the UHPC concrete portion 6 and the foam portion 8—matching the precise dimensions intended. In some embodiments, the steel frame 44 that was used as formwork is detached and not part of the final product (FIG. 13 corresponds to an embodiment without the frame 44). In other embodiments, the steel frame 44 (or some elements of it) is left embedded in the concrete and becomes a permanent part of the deck 2 (FIG. 14 shows an embodiment where the frame 44 remains). If the frame 44 is retained, it effectively serves as a built-in steel skeleton along the periphery of the deck 2, which can increase the deck 2's load capacity and edge impact resistance, as well as provide convenient hardpoints for lifting or for attaching other modules. If the frame is removed, deck 2 relies purely on the UHPC-and-foam composite for its strength, due to the strong bond and internal reinforcement. At this stage, the prefabricated deck 2 is complete as a structural element, exhibiting strength and stiffness for transport and installation.

Other Features—Filled Voids and Joints

As noted above, FIGS. 3-5 illustrate an optional technique of forming voids 42 within the foam portion 8 before casting concrete. These voids can be channels or shapes cut in the foam. When the UHPC mix is poured, it flows into these voids 42 and, upon curing, forms a concrete (e.g., UHPC) inflow pattern forming an integrated deflection-reducing shape. A number of shapes can be utilized to reduce deflection over long spans, e.g., corrugated profiles, ribs, waffles. This creates a robust mechanical interlock between the concrete and foam, dramatically increasing the composite's structural rigidity and ensuring the two materials act together (the foam is effectively "locked" in place by a lattice of concrete). In addition to or in place of such voids, other interface enhancements can be employed. For example, the surface of the foam 8 might be roughened or coated with a specialized bonding agent to improve adhesion. In some embodiments, a thin polymer emulsion or epoxy is applied to the foam surface to increase its wettability, and a fiber mesh can be laid on the foam; when the UHPC is cast, the mesh becomes embedded and helps tie the foam and concrete layers together. These measures further strengthen the bond at the interface and can be useful if the design anticipates heavy shear forces.

Figure 15:
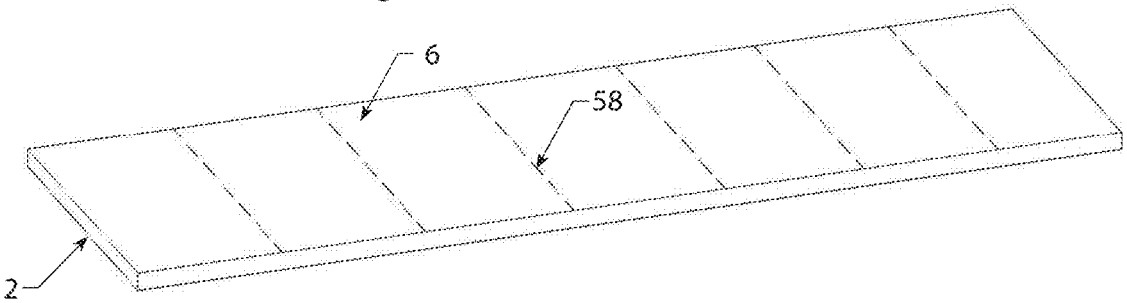
FIG. 15 illustrates alternative control-joint patterns that can be formed in the upper concrete surface of the deck.
Figure 16:
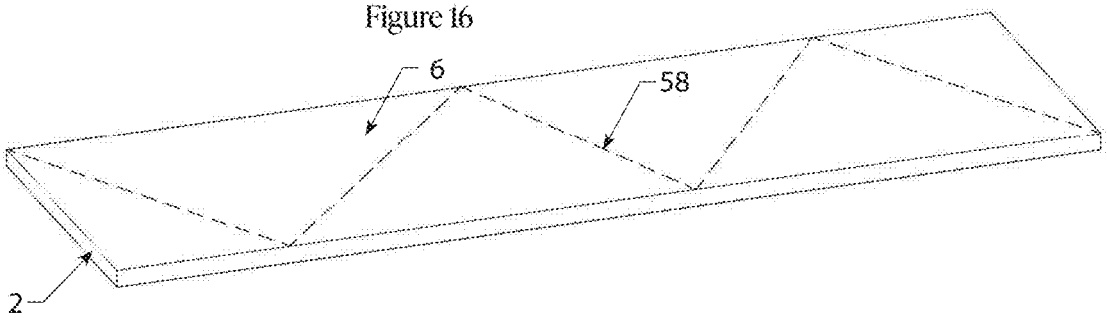
FIG. 16 illustrates alternative control-joint patterns that can be formed in the upper concrete surface of the deck.

Another feature that can be incorporated into deck 2 is the use of control joints 58 in concrete portion 6. FIGS. 15 and 16 show examples of different patterns of control joints 58 that can be impressed or cut into the top surface of deck 2. These joints (which might be straight lines, grids, etc., depending on the design) are intended to control cracking by localizing any shrinkage or thermal movement of the concrete. They predefine weak lines so that if the concrete does experience minor cracking, it will occur along these neat lines rather than randomly across the surface. The use of control joints 58 is optional and may be chosen based on aesthetic or climate or engineering considerations. In many UHPC applications, the material's high shrinkage resistance means control joints can be minimal, but they can be available as a tool to reduce mitigate against unsightly cracks over time.

Attachment of Transport Components and Stabilization Structure (FIGS. 17-25)

Figure 17:
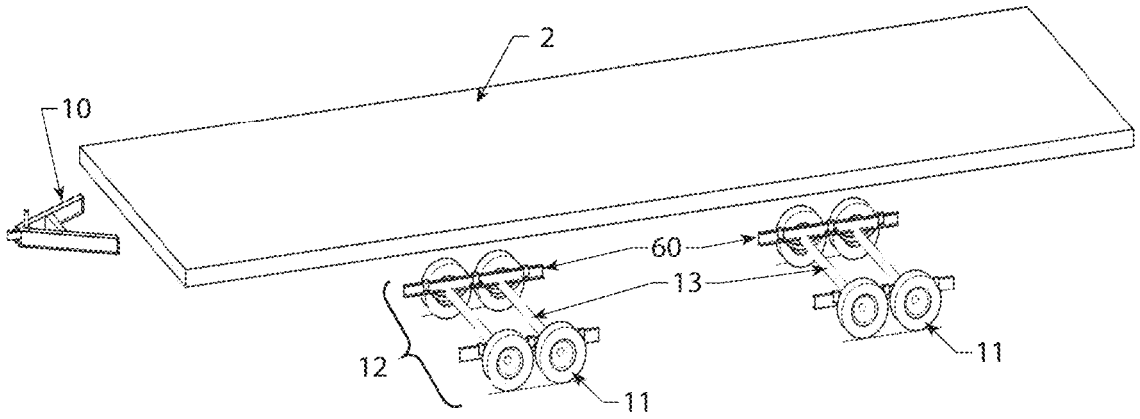
FIG. 17 is a perspective view showing mounting of transport components to the deck, including the hitch and axle assemblies.
Figure 18:
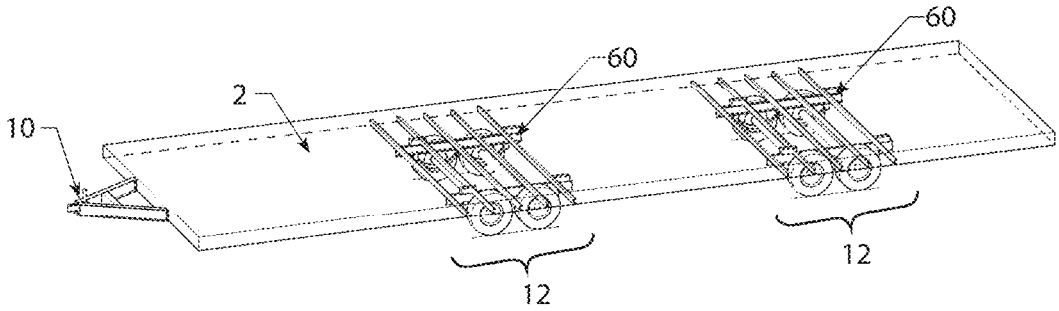
FIG. 18 is a perspective view showing mounting of transport components to the deck, including the hitch and axle assemblies.
Figure 21:
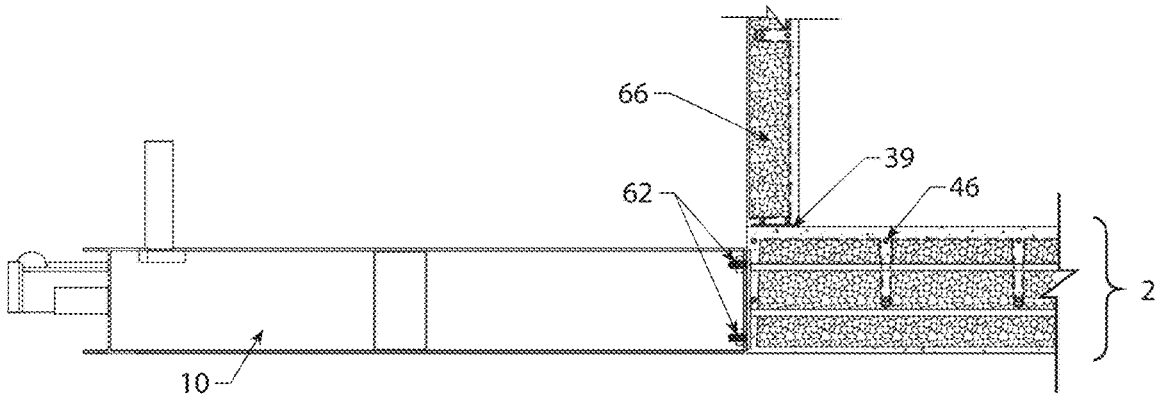
FIG. 21 is a view showing a wall panel attached to the deck at connection points and illustrating alternate connection techniques.
Figure 22:
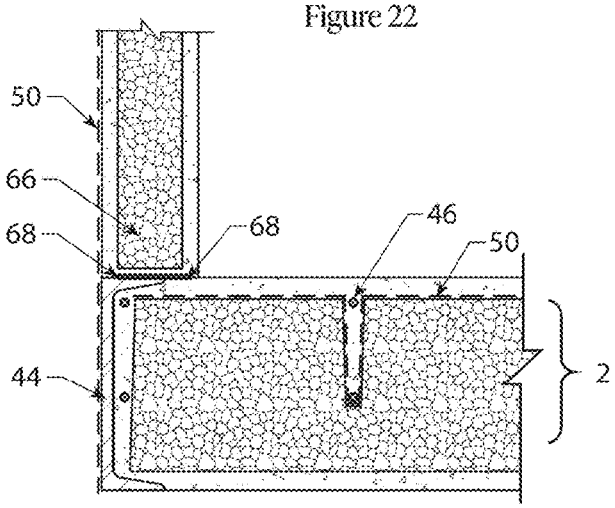
FIG. 22 is a view showing multiple wall panels joined to each other and to the deck, including gaskets and an exterior air barrier.
Figure 23:
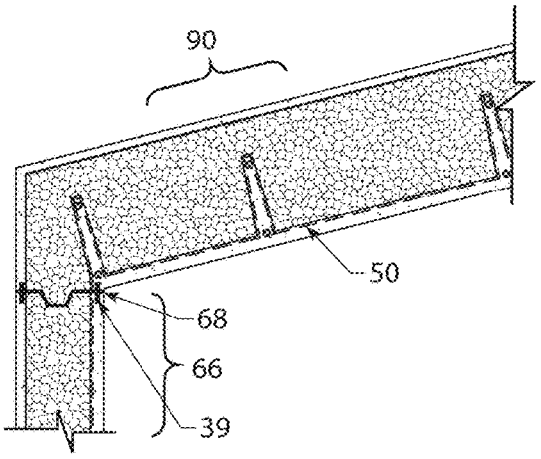
FIG. 23 is a view showing attachment of a roof panel to the wall panels and deck with gaskets sealing the joints.

After fabrication, deck 2 can be outfitted with transport components and, in many cases, a stabilization structure 14 (e.g., building elements like walls) prior to delivery. FIGS. 17 and 18 illustrate how axle assemblies 12 and a hitch 10 are mounted, and FIGS. 21-23 illustrate the attachment of wall panel 66 and roof panel 90 to create a unified module for transport.

Transport Components (Wheels and Hitch)

As illustrated in FIGS. 17 and 18, the prefabricated deck 2 is equipped for towing by attaching a hitch 10 at one end and a pair of removable axle assemblies 12 underneath. Each axle assembly 12 typically includes at least two wheels 11 (one at each end of axle 13); in the example of FIG. 17, a total of eight wheels are illustrated (two axles 13 with dual wheels 11 on each end). The axle assemblies 12 are secured to the deck via structural axle supports 60 that run along the underside of the deck. These supports 60 distribute the weight of the deck 2 along the length of the axles, preventing point loads and ensuring that forces are spread evenly into concrete portion 6. In effect, once the axle assemblies 12 and hitch 10 are attached, the deck 2 functions as a trailer chassis for road transport. Break lights and turn lights can be added temporarily.

Figure 19:
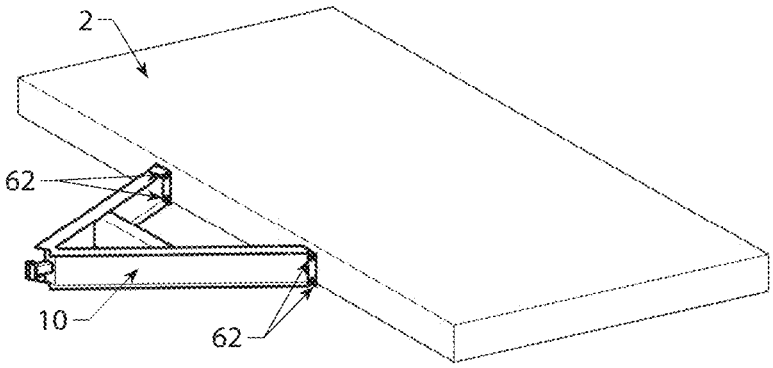
FIG. 19 is a detailed view showing the hitch releasably attached to the deck by fasteners.
Figure 20:
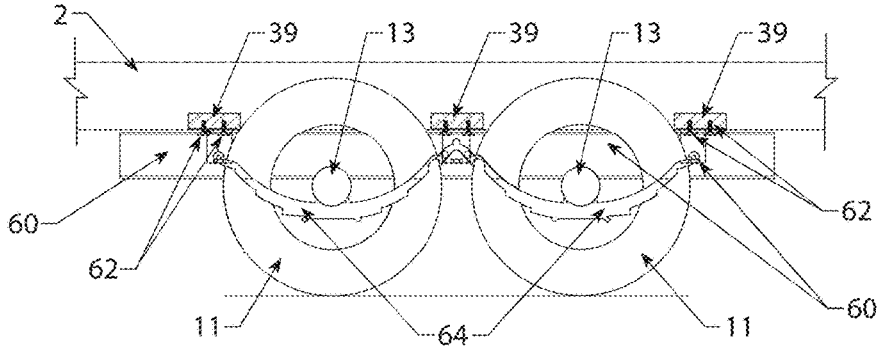
FIG. 20 is a detailed view showing the axle supports and fasteners used to attach axle assemblies to the deck, including a suspension system.

FIG. 19 shows that the hitch 10 can be releasably attached to a reinforced front region of the deck 2 using fasteners 62 (for example, bolts or heavy-duty screws threaded into cast-in inserts). Likewise, FIG. 20 shows fasteners 62 used to secure the axle support brackets 60 of the axle assemblies 12 to the underside of the deck 2. These connections are engineered to be strong enough for towing yet removable upon installation. Suspension system 64 may be integrated with the axle assemblies 12 (as indicated schematically in FIG. 20) to absorb shocks and vibrations during transportation, protecting the deck 2 (and any structure 14 mounted on it) from road impacts.

Stabilization Structure (Walls and Roof Panels)

In some embodiments, a primary advantage of this system is that a building's structural shell (walls and roof) can be pre-attached to the deck 2 off-site 4, creating a nearly complete unit that can be transported as one piece. FIG. 21 illustrates an example wall panel 66 positioned for attachment to deck 2. The wall panel 66 can itself be a composite element (it may be fabricated using UHPC and foam (like the deck 2), or using other materials depending on the design). To join wall panel 66 to the deck 2, connection points 16 corresponding to those on the deck 2 (item 16) are utilized. There are multiple processes to achieve a secure connection between the wall and deck 2, including:

Embedded Rods

During casting of the deck 2 (and/or the wall panel 66), threaded rods or stud anchors can be cast so that they protrude from the mating surfaces. For instance, a series of vertical rods might extend upward from the deck 2 edge, aligning with holes or sleeves in the base of the wall panel. These rods can have opposite threading on each end; once the wall panel 66 is placed, nuts 70 are applied from both sides and tightened to clamp the wall panel 66 down onto deck 2. This creates a strong bolted connection that can be released if so desired (by removing the nuts 70).

Embedded Plates/Extensions

Another approach is to cast small steel plates or L-shaped extensions into the deck 2 edge and the bottom of the wall panel 66. After the wall is positioned, these embedded plates line up next to each other, and bolts or welds can be used to join them. For example, a wall panel 66 might have steel tabs sticking out at its base, which correspond to threaded inserts in deck 2; workers can bolt through these tabs into the inserts, locking wall panel 66 to deck 2. In embodiments where the deck 2's formwork frame 44 was left in place as a peripheral steel frame (see FIG. 14), that frame can provide an easy means to bolt the wall panel 66's metal frame 24 to the deck 2's frame 24, achieving a rigid steel-to-steel connection.

External Brackets or Connectors

In some cases, separate metal brackets can be used to join the wall and deck 2. This might involve angle brackets that are screwed into inserts on both deck 2 and wall, or post-tensioned cables that run through aligned ducts in the wall and floor and are then tightened. These solutions can supplement the above processes to ensure alignment and stability.

Another approach is to join with the embed plates and fasteners, and to add to the structural robustness, add another layer of concrete to span over the wall and deck and roof joints to produce a more monolithic structure, if it need not be disassembled.

These joining processes are not mutually exclusive—an assembly could incorporate threaded rods as well as bolted plates for redundancy. The goal in all cases is to securely unite the wall panels 66 with the deck 2 so that the combined structure can resist lifting and racking forces (especially during transport). Once attached, the wall panels 66 and deck 2 effectively form a single structural unit.

FIG. 22 illustrates additional details for sealing the joints between panels. When wall panels 66 are joined to each other and to the deck 2, gaskets 68 can be placed along the mating edges. These gaskets 68 can be strips of closed-cell foam or rubber that compress when the panels are bolted together, thereby sealing any gaps. The gasket 68 prevents water or air infiltration at the panel seams. Furthermore, an air barrier 50 (for example, a house-wrap membrane) can be applied over the exterior of the assembled structure, spanning across panel joints. In FIG. 22, such an air barrier 50 is shown covering the seam between two wall panels 66 and between the wall and the deck 2, providing an extra layer of weather protection and improving energy efficiency by stopping drafts. After all wall panels 66 are erected and fastened, they form the perimeter of a building on the deck 2. Interior walls can be mounted similarly to exterior walls if they are concrete. There can be anchors placed as embeds during the concrete pour, or one can "shoot" or drill in anchors into the concrete where needed. Since the interior walls need not always be structural, they can be placed with post-installed systems. One can also use specialized nail guns for concrete, e.g., if interior walls are made with lumber. At this stage, the module at the off-site 4 location resembles a boxed structure for a prefabricated house or building or portion thereof.

FIG. 23 illustrates the attachment of a roof panel 90 to the top of the wall panels 66. The roof panel 90 can be fabricated in a manner like deck 2 (e.g., UHPC with internal insulation), or it could be another material, but in either case it is designed to span the walls. To install the roof panel 90, it may have corresponding connection elements that align with inserts or protrusions on the tops of the wall panels 66 (like the wall-to-deck connections described earlier). Once lowered into place, the roof panel 90 is secured—for example, via bolts or welded brackets at the wall tops—to complete the structural enclosure. A gasket 68 or sealant can be used along the roof-wall interface to make it watertight. With the roof panel 90 in place, the prefabricated module now comprises a deck 2 (floor) 2, walls 66, and a roof 90, all connected.

Transport Preparation

Figure 24:
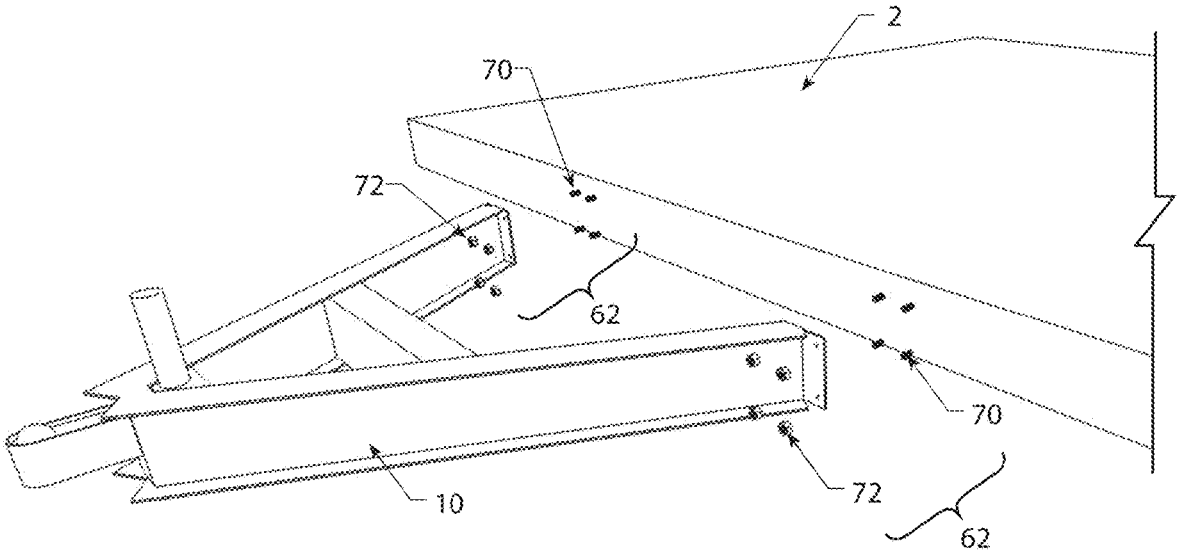
FIG. 24 is a detailed view showing nuts and bolts connecting the hitch to the deck.
Figure 25:
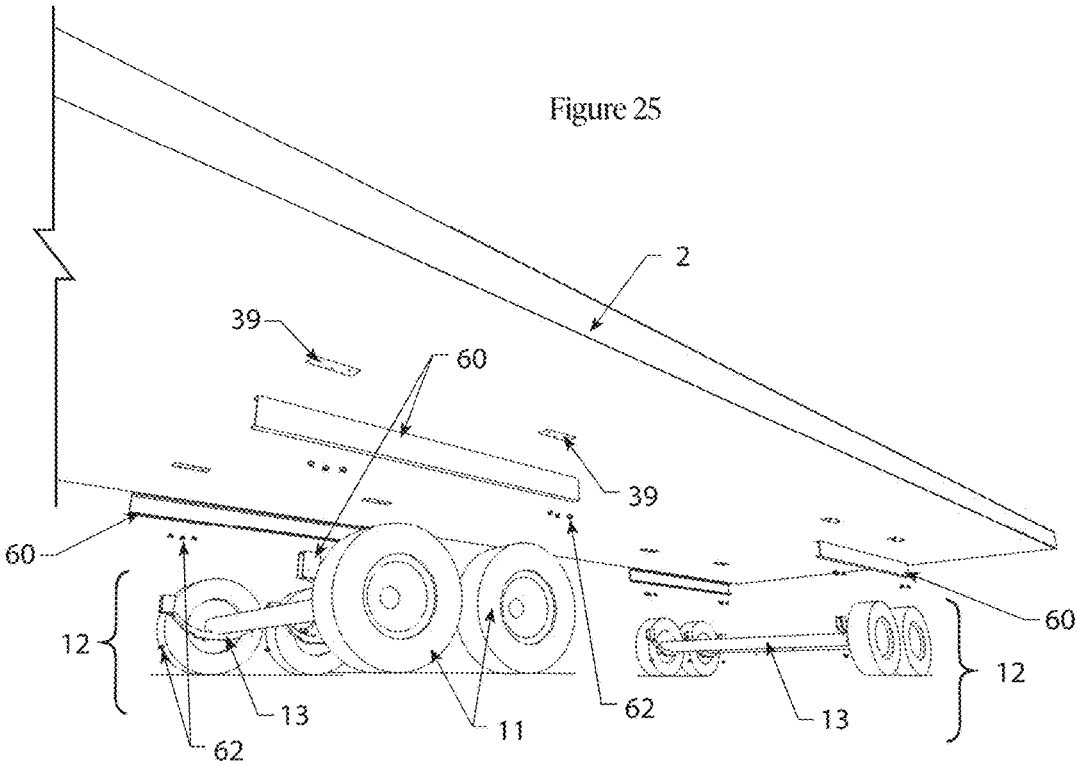
FIG. 25 is a view illustrating the attachment of axle assemblies to the deck.

FIG. 24 provides a detailed view of how hitch 10 is connected to deck 2. In this embodiment, nuts 70 and bolts 72 (which were cast into or embedded in the concrete portion 6 during fabrication) serve as the attachment means. The hitch 10—which typically includes a steel tongue and coupling mechanism—is aligned with these cast-in bolts 72 and secured with nuts 70, ensuring a strong connection suitable for towing. FIG. 25 shows another perspective of the axle assembly 12 mounting to the deck 2: the axle supports 60 are fastened to the underside of the deck 2 (for instance, via bolts 72 through embed plates 39 in the concrete), and the wheels 11 are positioned to support the weight. In this configuration, the entire assembly (deck 2, attached stabilization structure 14, wheels 11, and hitch 10) is ready to be moved as a single unit.

Transport, Delivery, and Installation at Site (FIGS. 26-30)

Figure 26:
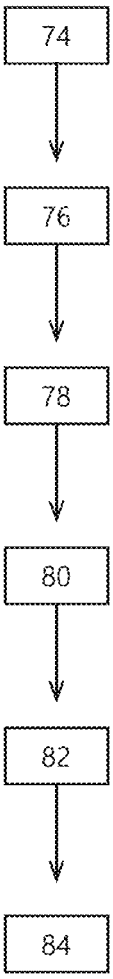
FIG. 26 is a flow diagram illustrating the attachment, transport, detachment, and installation steps for the stabilization structure and deck.

With the prefabricated deck 2 module fully assembled and equipped, it is transported to the delivery site for installation. FIG. 26 is a flow chart summarizing the sequence of attachment, transport, detachment, and installation steps, and FIGS. 27-30 illustrate these steps in practice.

Figure 27:
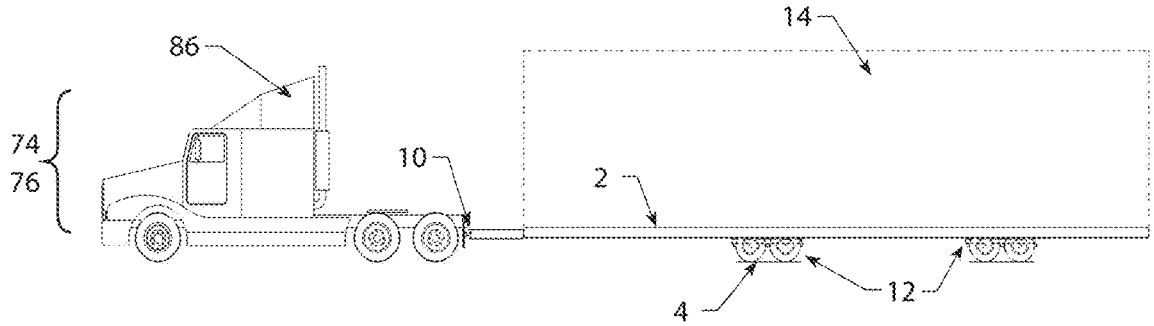
FIG. 27 is a view showing a vehicle coupled to the hitch for transport of the deck and stabilization structure from the off-site location.

At the off-site 4 location, deck 2 (supporting the stabilization structure 14, e.g., a house) is hitched to a towing vehicle 86 (Block 74 in FIG. 26). FIG. 27 corresponds to this condition, showing the vehicle 86 attached via hitch 10 to the deck 2, which in this example carries a small building (stabilization structure 14) on it. The module serves as a trailer for transport. It is then driven via roadway to the delivery site 88 (Block 76). Because the deck 2 can double as the trailer chassis, no separate flatbed is required; this reduces transport complexity. The relatively light weight of the module (thanks to the foam core and optimized UHPC structure) means that standard trucks can typically tow it without special permits, and the high rigidity of the deck 2 prevents undue flexing during the journey.

Figure 28:
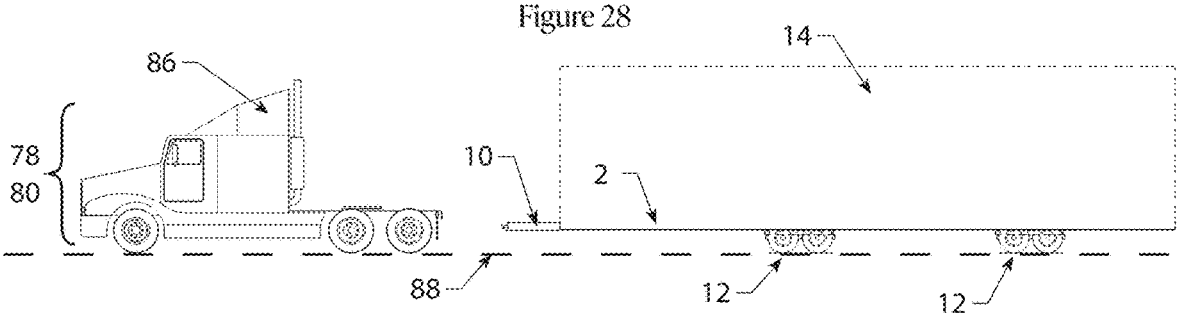
FIG. 28 is a view showing the vehicle unhitched from the deck at the delivery site.
Figure 29:
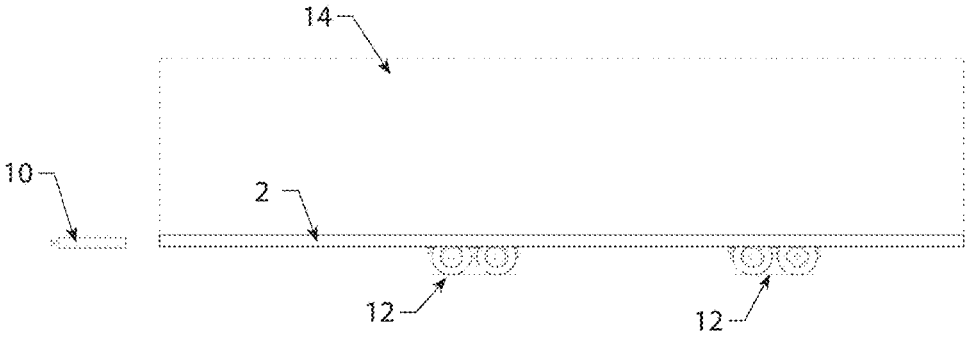
FIG. 29 is a view showing removal of the hitch from the deck after delivery.

Upon arrival at delivery site 88, the next steps are to detach the transport components and secure the structure in its final position. FIG. 28 (corresponding to Block 78) illustrates the vehicle 86 being unhitched from the module—i.e., the towing vehicle is disconnected from hitch 10. Then, as shown in FIG. 29 (Block 80), hitch 10 itself is removed from the deck 2. The hitch may be unbolted and set aside, allowing it to be reused for transporting another module. At this stage, the module is sitting on its wheels 11 at the site with no towing vehicle attached.

Figure 30:
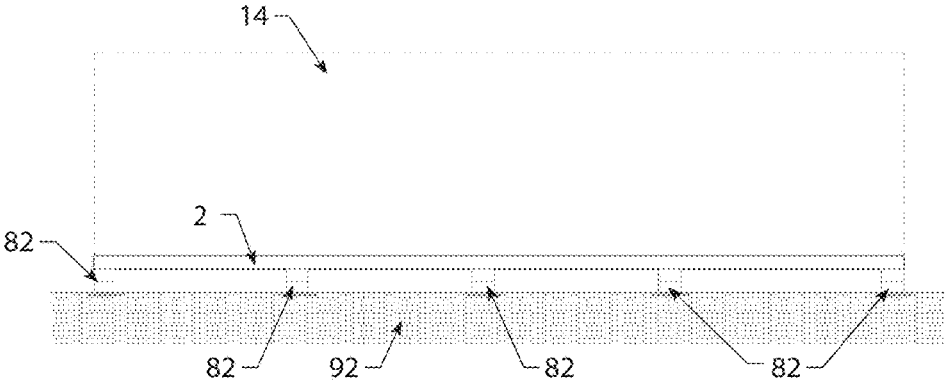
FIG. 30 is a view showing placement of the deck on piers and removal of the axle assemblies at the delivery site.

Next, the deck 2 is placed on a foundation at the site (Block 82). FIG. 30 illustrates one common approach, where the module is jacked up slightly to remove the axle assemblies 12 and then lowered onto a series of piers 82 that transfer the load to the ground (soil 92). In the figure, the deck 2 is shown supported on piers 82, creating a crawl space 94 underneath. Alternatively, depending on design and local requirements, the deck 2 could be placed on other types of foundations—for example, a continuous footing, a slab-on-grade, or even directly on a stable surface or blocks in temporary scenarios. The axle assemblies 12 are optional to remove; in some cases (such as a temporary deployment or if future relocation is planned) the wheels 11 might be left on, but typically for permanent installation they are detached to give the building a permanent, secure seating. Once the deck 2 is on its foundation, final installation steps (Block 84) include anchoring and finishing: straps or tie-downs 84 can be used to secure the deck 2 to the piers 82 or foundation (guarding against uplift from winds or seismic activity), and if the structure is elevated, decorative underpinning or skirting can be added around the base for aesthetic appeal and to enclose the crawl space 94. At this point, the prefabricated deck 2 (with its stabilization structure 14, e.g. house, on it) has been converted from a mobile module into a permanent part of the building on site. The transport components (hitch 10 and axle assemblies 12) are removed, leaving no trace on the final building other than the connection points 16 which can be sealed or covered. The utilities that were pre-installed in the deck 2 can now be connected to site connections (for instance, hooking the deck 2's plumbing lines to the sewer and water lines in the ground, and connecting electrical conduits to the grid or a generator). The building is now ready for use, having been delivered and installed with minimal on-site construction needed.

Modular Configuration and Expansion Options (FIGS. 31-36)

Figure 31:
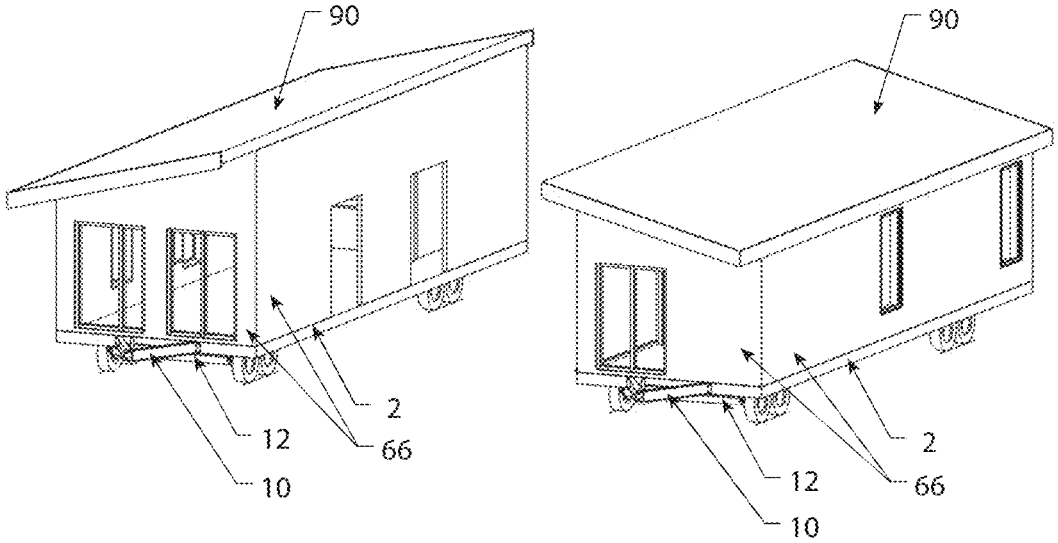
FIG. 31 is a schematic showing one deck joined to another to form a combined structure.

The UHPC-and-foam deck system is highly modular. Multiple prefabricated decks can be joined together to create larger buildings or complex layouts, offering flexibility beyond single-unit installations. FIG. 31 illustrates an embodiment in which two decks 2 are positioned side by side to form a larger combined floor area. In this "double-wide" configuration (commonly used in modular homes), each deck 2 module is fabricated as described above-they may each be transported with their own stabilization structure 14 (e.g., each half of a house). Once on site, the two units are aligned next to each other at a mating seam. In embodiments where the stabilization structures 14 (house halves) are detachable for transport, the joining of the deck 2 modules can occur before or after those structures are placed. For example, two floor decks 2 could be joined first on a foundation, and then a larger stabilization structure (spanning both) could be assembled on top; or, as another approach, each deck 2 might carry half of a house that is already built, and the halves are simply connected together on delivery site 88.

Figure 32:
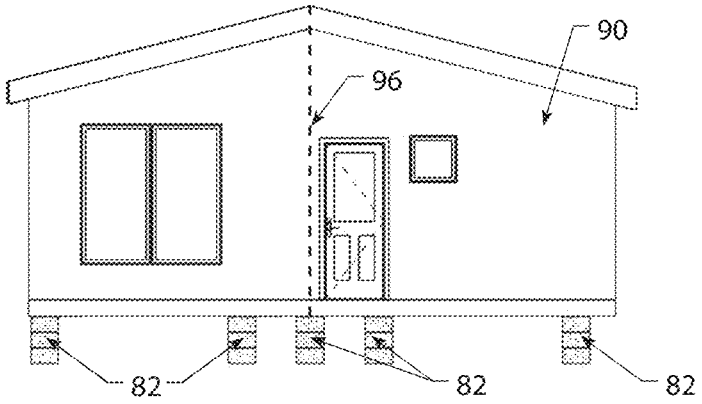
FIG. 32 is a perspective view showing two decks with wall panels, hitch, and roof panels joined at a mate line.
Figure 33:
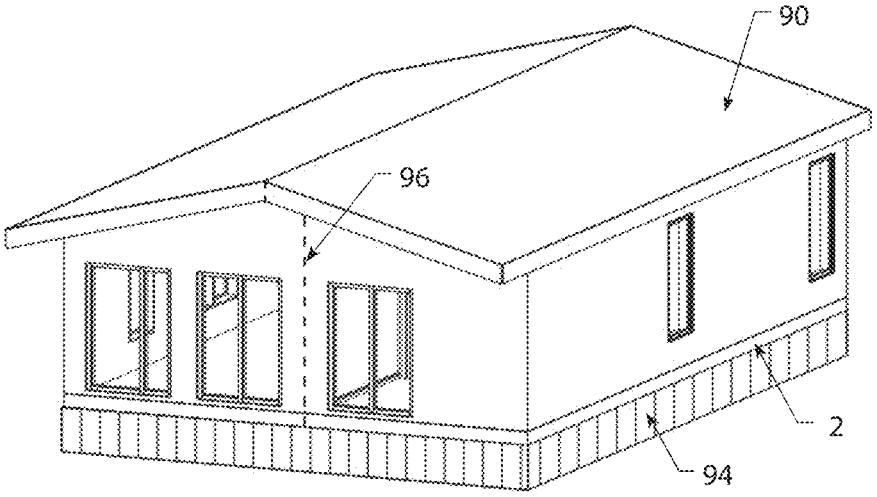
FIG. 33 is a perspective view showing a double-wide house formed by two decks mounted on piers with a crawl space beneath.

FIG. 32 shows two decks 2 each outfitted with wall panels 66, a hitch 10, axle assemblies 12, and a roof 90, prior to joining. After delivery, the axle assemblies 12 are removed and each deck 2 is placed on its set of piers. The modules are then pushed or craned into position so that they abut along a mate line 96. At this joint, the two decks 2 are connected together using appropriate fasteners 62 or brackets. For instance, if each deck 2 had steel frame 44 at its edges, those frames 44 could be bolted or welded. Or, if the edges are concrete, plates or threaded inserts cast into each can be bolted together. The connection at mate line 96 ensures the two modules act as one continuous structure. Straps or splice plates (item 84) can be used across the seam for added stability. Once joined, the interface can be sealed and covered (similar to how panel joints are treated) to create a uniform interior floor. FIG. 33 shows the resulting double-wide house-essentially a single larger building composed of the two joined deck 2 modules. In this example, a crawl space 94 is present beneath the combined structure (since each module was set on piers 82, leaving an open gap that can be utilized for utilities or simply ventilated). It is contemplated that more than two modules can be combined in analogous fashion to create even larger structures—for example, a triple-wide (three modules forming a large open plan) or other multi-unit combinations for commercial or residential buildings. Conversely, a single module can serve as a complete small building by itself. The ability to connect decks 2 gives designers and builders a "Lego-like" flexibility in configuring floor plans.

Figure 34:
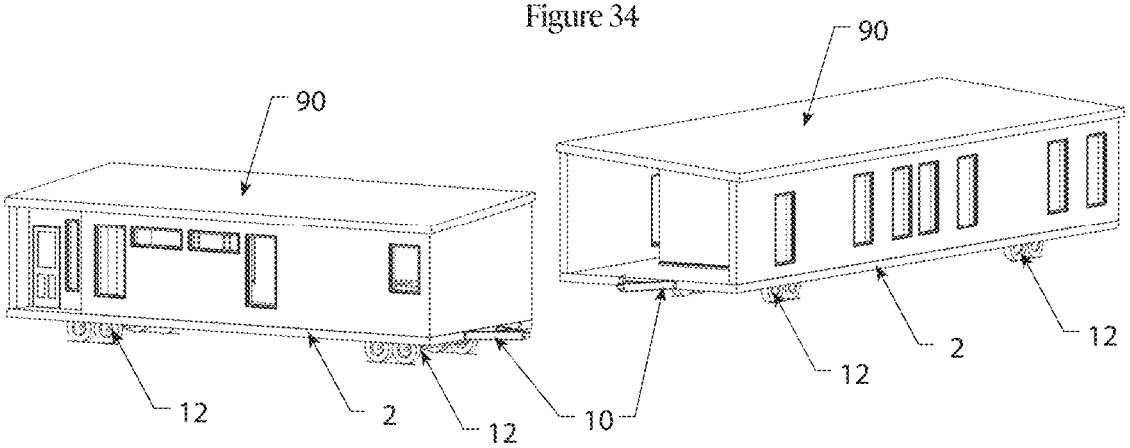
FIG. 34 illustrates an L-shaped configuration of multiple decks joined at right angles.
Figure 35:
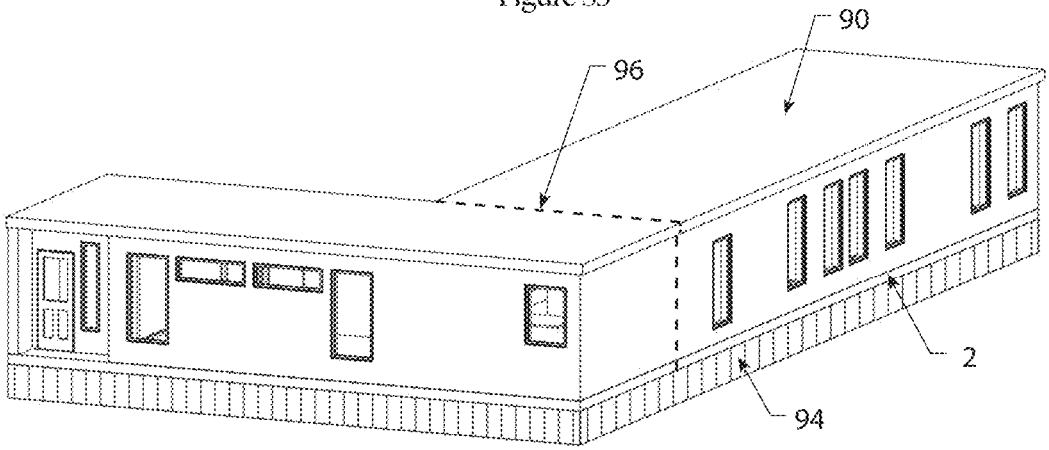
FIG. 35 illustrates an L-shaped configuration of multiple decks joined at right angles.
Figure 36:
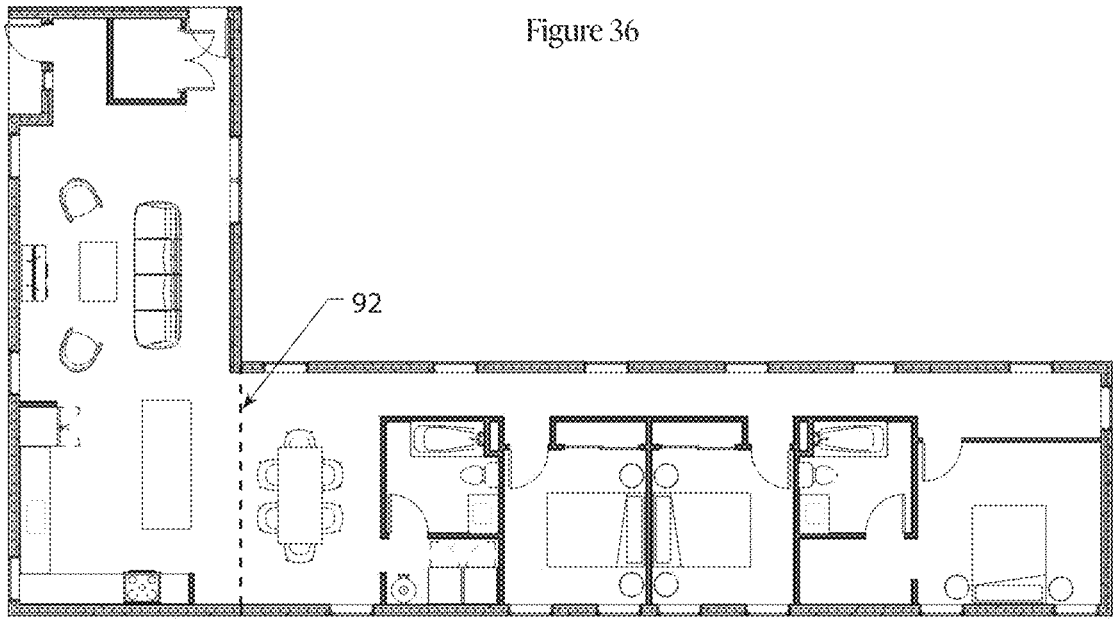
FIG. 36 is a floor plan showing a stabilization structure configured as an L-shaped house on prefabricated decks.

In addition to side-by-side expansion, modules can be joined at angles to create different building shapes. FIGS. 34 and 35 show an L-shaped configuration, wherein two decks 2 are connected perpendicular to each other to form an "L" floor plan. This could be used for an L-shaped house or building wing. Similarly, T-shaped or U-shaped layouts can be achieved by connecting three or more modules in the appropriate arrangement. The connections at the joints can be made in the same manner as described for linear joints—using bolts, weld plates, or other fastening means at the abutting edges, and sealing the seams. FIG. 36 provides a top-down floor plan view of an example L-shaped house assembled from two prefabricated deck 2 modules (each module supporting part of the overall structure). These examples demonstrate that the prefabricated UHPC-foam deck 2 system can scale and link together to accommodate larger or uniquely shaped buildings. Modules can be added or removed in future expansions or reconfigurations, which is advantageous for evolving space needs. All while, each individual module retains the benefits of a UHPC structure (strength, insulation, durability), and when joined properly, the composite of modules is as structurally sound as a single larger unit would be. Note that embodiments can include shipping the deck 2, wall panel(s) 66, and roof panel(s) 90 separately and assembling them at the delivery site 88.

FIG. 36 is an illustration of an "L" floor plan with a mate line 96.

Figure 37:
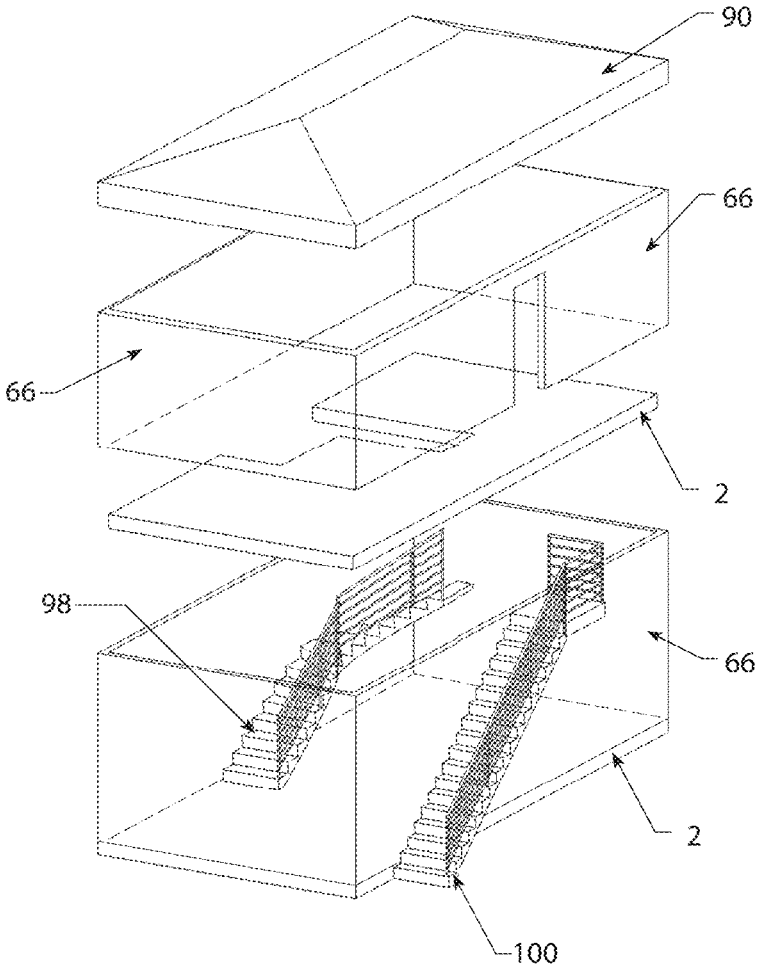
FIG. 37 is an exploded view of a multistory embodiment.

FIG. 37 is an exploded view of a multistory embodiment. Stair access that can be internal (e.g., stairs 98) and/or external (adjacent to the structure, e.g., stairs 100) and there could be one or more access stairs, depending on requirements. If the stairs are internal, there can be a leave out in deck 2, in FIG. 37 a generally "L" shaped leave out, for the stair connection between floors. Regarding stacked versions, deck 2 can be placed on top of the ground floor level walls 66, so that deck 2 serves as the ceiling for the space below and the floor for the space above. The topmost wall panels 66 have roof panel 90 connected to the upper-level wall panel 66.

Applications Beyond Residential Housing

Beyond the single-family home scenarios depicted above, the prefabricated UHPC-and-foam deck system can be applied to a wide range of other uses where rapid installation, strength, and portability are desired.

Modular Components—Replaceable Parts

One or more deck(s) 2, wall panel(s) 66, and roof panel(s) 90 can be fabricated off-site 4, transported to the delivery site 88, and then assembled. In some embodiments, one or more deck(s) 2, wall panel(s), and roof panel(s) 90 can be extricated from a finished structure and replaced with another of the deck(s) 2, wall panel(s), and roof panel(s) 90. For example, with the oppositely-threaded bolts 72 and nuts 70 as a joint system, a prefabricated house or building cannot be disassembled in whole or part at the delivery site 88 to replace, say, a damaged wall panel 66. Consider an application such as a military building, discussed further below, with a wall damaged by projectiles or an explosion. The roof panel 90 can be unbolted, a crane can lift the roof off, the joints between wall panels 66 and to the deck 2 can be unbolted, and a crane could remove the damaged wall panel 66 and replace it, rebolting the building back together. The electric lines would be pulled for removal and then replaced when the building is reassembled.

Commercial and Industrial Structures

Embodiments can be used to create modular offices, retail kiosks, field clinics, classroom units, or other commercial buildings that benefit from accelerated construction. Entire floor modules with pre-installed utilities can be manufactured off-site 4 and then delivered to form, for example, a modular office park or pop-up retail space. The high strength of the UHPC deck 2 allows it to support heavy equipment or high occupant loads (as needed in commercial settings), while the integrated foam insulation enhances energy efficiency for climate control. The construction process is streamlined-modules are made in a factory and simply assembled on-site-reducing downtime for businesses. Moreover, the resulting structures are durable and require minimal maintenance, as UHPC is highly resistant to wear and environmental damage. Modules can be designed for disassembly and relocation, offering flexibility for temporary installations or future expansion of facilities.

Disaster Relief and Emergency Housing

The portability and robustness of these prefabricated modules make them useful for disaster relief scenarios and other emergency housing needs. After events such as earthquakes, hurricanes, or floods, a number of deck 2 modules could be quickly produced or repurposed and transported to the affected area to serve as immediate shelters or field hospitals. Their UHPC construction provides a very high level of resilience against extreme conditions—the modules can withstand high winds, impacts from debris, and even seismic shocks without collapse. This is because UHPC has notable strength and crack control, and when combined with the composite foam core, the panels can absorb and dissipate significant energy. The foam core's insulation can be useful in disaster scenarios, keeping occupants protected from temperature extremes when infrastructure is compromised. Additionally, since the modules are self-contained (with integrated structure and floor), they can be deployed on simple supports or on a stable surface, and then later relocated or made permanent if so desired. In relief operations, for speed of deployment, a set of modules can be trucked in and assembled into a small village of shelters in days, providing safe, warm, and sturdy housing far superior to tents or makeshift huts. Once they outlive their temporary use, the same modules can be recovered and stored or moved to the next location, owing to their strength and durability.

Military and Field Deployments

The prefabricated UHPC-foam deck system is well-suited for military applications and other field deployments as robust, quickly deployable structures. UHPC was originally developed in part for its use in protective structures, offering blast resistance and high survivability. Panels made of UHPC have been shown to be an order of magnitude stronger than normal concrete and to last far longer under harsh conditions. This makes them excellent for building hardened command centers, barracks, or armories for withstanding explosions, projectiles, or other impacts better than conventional materials. A deck 2 can serve as a basis for such facilities, or multiple deck 2 modules could form larger complexes (for example, a series of connected modules for a field hospital or mobile radar station). Because the modules are and have a high strength-to-weight ratio, they can be transported by military logistics (truck, rail, or even airlift by cargo plane or helicopter for smaller units) and rapidly installed on prepared footings or on a stable surface; and in some cases, individual decks 2, wall panels 66, and roof panels 90 can be conveyed individually and assembled on site. The foam core provides inherent thermal insulation which is advantageous in extreme climates (keeping personnel comfortable in hot deserts or cold environments without excessive energy use for heating/cooling). Moreover, the durability of UHPC means the modules can be deployed for years with minimal degradation—indeed, UHPC structures are expected to endure for decades uhpcsolutions.com. This longevity and reusability are cost-effective for the military: the same units can be moved from one theater to another as may be needed. In summary, the system offers a combination of quick setup, portability, structural integrity, and protection that is highly valuable for defense and emergency preparedness applications.

In such applications, the prefabricated UHPC-and-foam deck system provides a unique blend of benefits: high structural performance (at least comparable to permanent reinforced concrete construction), excellent thermal insulation, and greatly reduced weight for ease of transport. The ability to integrate utilities and even upper structures (walls/roofs) in the factory means that on-site work is minimized, which is particularly useful in remote, hazardous, or post-disaster environments. The neutral, modular nature of the design allows it to be adapted to different sizes and purposes—from a single-module tiny home or bunker to multi-module complexes for commercial or public use. As demonstrated in the figures and descriptions above, this system enables the concept of a "plug-and-play" building core: a strong, insulated deck 2 that can be fabricated off-site 4, moved to where it is needed, and then serve as the literal and figurative platform upon which habitable structures are built. The result is a versatile construction approach that addresses modern needs for efficiency, resilience, and flexibility in building deployment.

V. INDUSTRIAL APPLICABILITY

As disclosed, the articles, apparatuses, and processes and products produced thereby are applicable to factory fabrication, transport, installation, and use of prefabricated buildings/parts, including residential and commercial structures. The systems reduce on-site labor, improve quality, and enable repeatable, code-compliant assemblies.

VI. SCOPE

In sum, it is important to recognize that this disclosure has been written as a thorough teaching rather than as a narrow dictate or disclaimer. Reference throughout this specification to "one embodiment", "an embodiment", or "a specific embodiment" means that a particular feature, structure, or characteristic described in connection with the embodiment is included in at least one embodiment and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment may be combined in any suitable manner with one or more other embodiments. It is to be understood that other variations and modifications of the embodiments described and illustrated herein are possible in light of the teachings herein and are to be considered as part of the spirit and scope of the present subject matter.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. Variation from amounts specified in this teaching can be "about" or "substantially," so as to accommodate tolerance for such as acceptable manufacturing tolerances.

The foregoing description of illustrated embodiments, including what is described in the Abstract and the Modes, and all disclosure and the implicated industrial applicability, are not intended to be exhaustive or to limit the subject matter to the precise forms disclosed herein. While specific embodiments of, and examples for, the subject matter are described herein for teaching-by-illustration purposes only, various equivalent modifications are possible within the spirit and scope of the present subject matter, as those skilled in the relevant art will recognize and appreciate. As indicated, these modifications may be made in light of the foregoing description of illustrated embodiments and are to be included, again, within the true spirit and scope of the subject matter disclosed herein.

The invention claimed is:

1. A prefabricated structure comprising:

a deck configured to form a vehicle trailer chassis, the deck comprising:

a frame;

a foam portion positioned within the frame and a concrete portion at least partially covering the foam portion;

one or more channels defined in the foam portion having at least one utility conduit positioned therein;

one or more reinforcement components embedded in the concrete portion; and one or more connection points connected to the frame and protruding outwardly from the concrete portion, the concrete portion at least partially covering the one or more connection points;

an axle assembly removably coupled to a first said connection point disposed on a bottom side of the deck and configured to transport the deck to a delivery location; and a hitch removably coupled to a second said connection point disposed on a front side of the deck and configured to transport the deck via the hitch.

2. The prefabricated structure of claim 1, wherein the concrete portion of the deck comprises an ultra-high-performance concrete.

3. The prefabricated structure of claim 1, wherein the at least one utility conduit positioned within the one or more channels includes integrated utility conduits for connection to site utilities.

4. The prefabricated structure of claim 1, wherein the deck is a first deck, the first deck configured to couple to a second deck at the delivery location, wherein the first deck and the second deck are coupled in a single-floor orientation.

5. The prefabricated structure of claim 1, wherein the deck is configured as a portion of a multi-story building assembled at the delivery location.

6. The prefabricated structure of claim 1, wherein the deck is transported to the delivery location on the axle assembly.

7. The prefabricated structure of claim 6, wherein the hitch is configured to engage a vehicle to transport the deck via the hitch to the delivery location.

8. The prefabricated structure of claim 7, wherein the deck forms the vehicle trailer chassis.

9. The prefabricated structure of claim 1, further comprising a stabilization structure comprising at least one wall panel, wherein the at least one wall panel is coupled to a third connection point of the deck.

10. The prefabricated structure of claim 9, wherein the stabilization structure comprises a plurality of wall panels defining a room therebetween, and at least one roof panel coupled to the plurality of wall panels, such that the stabilization structure forms a building.

11. The prefabricated structure of claim 10, wherein the deck is a first deck, the first deck configured to couple to a second deck at the delivery location, wherein the first deck and the second deck are coupled in a single-floor orientation.

12. The prefabricated structure of claim 10, wherein the deck is configured to form, at the delivery location, a portion of a multi-story building.

13. The prefabricated structure of claim 10, wherein the building comprises a house.

14. The prefabricated structure of claim 13, wherein the house comprises a wall panel and a roof panel, wherein at least one of the wall panel or the roof panel comprises ultra-high-performance concrete, and wherein the foam portion of the deck provides thermal insulation for a bottom side of the house.

15. The prefabricated structure of claim 9, wherein the stabilization structure further comprises at least one roof panel coupled to the at least one wall panel, wherein the at least one wall panel or the at least one roof panel comprises ultra-high-performance concrete.

16. The prefabricated structure of claim 15, wherein the at least one of the roof panel and the at least one wall panel comprise an opening defined therethrough.

17. The prefabricated structure of claim 16, wherein the opening defined in the at least one roof panel or the at least one wall panel is configured for a door or a window to be coupled thereto.

* * * * *